US011976459B2

(12) United States Patent
Hoddinott

(10) Patent No.: US 11,976,459 B2
(45) Date of Patent: May 7, 2024

(54) POLYFORM FOLDING BUILDING SYSTEM

(71) Applicant: Polyform Construction Pty Ltd, Brisbane (AU)

(72) Inventor: David Hoddinott, Brisbane (AU)

(73) Assignee: POLYFORM CONSTRUCTION PTY LTD, Brisbane (AU)

( * ) Notice: Subject to any disclaimer, the term of this patent is extended or adjusted under 35 U.S.C. 154(b) by 263 days.

(21) Appl. No.: 17/609,644

(22) PCT Filed: May 13, 2020

(86) PCT No.: PCT/AU2020/050468

§ 371 (c)(1),
(2) Date: Nov. 8, 2021

(87) PCT Pub. No.: WO2020/227768

PCT Pub. Date: Nov. 19, 2020

(65) Prior Publication Data

US 2022/0228361 A1 Jul. 21, 2022

(30) Foreign Application Priority Data

May 15, 2019 (AU) ..... 2019901658

(51) Int. Cl.
*E04B 1/344* (2006.01)
*E04B 1/343* (2006.01)
(Continued)

(52) U.S. Cl.
CPC ..... *E04B 1/3441* (2013.01); *E04B 1/34363* (2013.01); *E04B 1/34384* (2013.01); *E04B 1/3445* (2013.01); *E04B 1/3483* (2013.01); *E04B 7/163* (2013.01); *E04H 1/02* (2013.01); *E04B 1/34317* (2023.08)

(58) Field of Classification Search
CPC ..... E04H 1/02; E04B 1/3441; E04B 1/34363; E04B 1/34384; E04B 1/3483; E04B 1/3445; E04B 1/34317; E04B 7/163
See application file for complete search history.

(56) References Cited

U.S. PATENT DOCUMENTS 4,630,627 A * 12/1986 Windows ..... E04H 15/48 135/912
2005/0044804 A1* 3/2005 Bin ..... E04B 1/3445 52/79.5

(Continued)

FOREIGN PATENT DOCUMENTS

DE 102018101157 A1 * 7/2019
GB 2115034 A * 9/1983 ..... E04B 1/3441

(Continued)

OTHER PUBLICATIONS www.youtube.com/watch?v=o8G9gF1K6WQ, published Aug. 31, 2017.
www.youtube.com/watch?v=AEfNLjPSIKs&t=0s, published Nov. 1, 2017.

*Primary Examiner* — Christine T Cajilig
(74) *Attorney, Agent, or Firm* — Fountainhead Law Group, P.C.; Jill A. Jacobson

(57) ABSTRACT

The present invention relates to a portable building assembly providing a complete structure configured for onsite construction. The structure once packed down can be delivered to site in a flat packed form most efficient for transportation.

20 Claims, 50 Drawing Sheets

(51) Int. Cl.

| | |
|---|---|
| ***E04B 1/348*** | (2006.01) |
| ***E04B 7/16*** | (2006.01) |
| ***E04H 1/02*** | (2006.01) |

(56) References Cited

U.S. PATENT DOCUMENTS

| | | | | |
|---|---|---|---|---|
| 2011/0005144 | A1* | 1/2011 | McDougall | E04B 7/04 52/173.1 |
| 2017/0030071 | A1* | 2/2017 | Sorensen | E04B 1/348 |
| 2017/0284080 | A1* | 10/2017 | Vidal de la Fuente | E04B 7/022 |
| 2018/0313075 | A1* | 11/2018 | Lucho Do Valle | E04B 1/34352 |

FOREIGN PATENT DOCUMENTS

| | | | |
|---|---|---|---|
| WO | 2010/061301 | A1 | 6/2010 |
| WO | 2020/227768 | A1 | 11/2020 |

* cited by examiner

POLYFORM FOLDING BUILDING SYSTEM

CROSS-REFERENCE TO RELATED APPLICATIONS

This application is a U.S. national stage application under 35 U.S.C. § 371 of PCT/AU2020/050468, filed on May 13, 2020, which claims priority to Australian application no. 2019901658, filed on May 15, 2019.

FIELD OF INVENTION

The present invention relates to a portable building assembly providing a complete structure configured for onsite construction. The structure once packed down can be delivered to site in a flat packed form most efficient for transportation.

BACKGROUND TO THE INVENTION

Over the past several decades the concept of prefabricated housing has come to the fore for several reasons. Builders like any manufacturer have looked to prefabrication in a factory or workshop to ensure a controlled environment in which to build their product.

A controlled environment ensures that workers can be housed in a climate controlled space where their production will be unaffected by external impediments, inclement weather, uneven surfaces, working at heights and manual materials handling to name a few.

Prefabricated building manufacture in a workshop or factory allows the builder to have a range of machinery and systems in place to assist with tasks such as material handling and the ability to have jigs and templates on hand to assist the efficient manufacture of building components.

Access equipment can be permanently assembled to allow safe and efficient access for workers to the relevant areas under construction removing the repeated cost of installation and disassembly and providing a safer working environment for staff.

Due to the efficiencies gained by this type of manufacturing over traditional onsite construction, it is widely accepted that buildings can be produced at a lower cost and to a higher standard of finish when built in a workshop or factory environment.

As populations grow across the world there is huge demand for high quality lower cost housing, a demand that can be met by prefabricated housing.

To date most prefabricated housing has been delivered in a few simple forms, each with its own merits, these are outlined below.

Frames and Stick Construction

Prebuilt wall frames, typically manufactured from steel or timber are manufactured off site to a plan and delivered to site by truck. Floor and roof components are constructed onsite from stick materials (Timber or steel joists cut to suit the specifications provided). Once delivered to site the prebuilt frames are assembled by suitably qualified trades people with a crane or other lifting equipment. Once the frame is erected the building is lined externally with cladding, windows installed, services fitted, sheeted internally and finished by various trades in a traditional fashion.

Frames and Panel Construction

Prebuilt wall frames and floor and roof cassettes typically manufactured from steel or timber with a suitable lining material applied are manufactured off site to a plan and delivered to site by truck. They are then assembled by suitably qualified trades people with a crane or other lifting equipment.

The building is then lined externally with cladding, windows installed, services fitted, sheeted internally and finished by various trades in a traditional fashion.

Panelised Construction

Externally pre sheeted wall panels are delivered to site with floor and roof cassettes which are then assembled into a complete structure. A range of panel materials have been used for this type of construction, ranging from metal sheet polystyrene core panels, timber framed composite panels with a range of exterior claddings and more recently CLT Cross Laminated Timber panels to name a few.

Once the panel installation sequence has been completed the building is then lined externally, windows installed, services fitted, sheeted internally and finished by various trades in a traditional fashion.

While efficiencies over traditional building systems can be found in all of the above mentioned systems, all of these products are still mostly unfinished and require a large amount of time and equipment onsite to finish the building, detracting from the key advantage of pre manufacture, being rapid onsite installation and finishing.

Alternatively, the Big Box construction requires a builder to manufacture the complete structure under roof and then transport the building to site complete, or in a series of sections which are then reassembled onsite.

While this option has proved to be an economically viable solution in a range of applications, for example temporary school buildings and workers accommodations, Big Box construction has its limitations. Cost of transport and installation is high when compared with traditional construction and the structural requirements of the building need to be over engineered to withstand the rigors of transportation.

The overall area of the factory that is required to manufacture these buildings is large, which has an impact on the overall cost of the structure due to the large overhead required for a specialised production facility.

Finally, due to the performance requirements of this type of building, the aesthetic considerations of these structures are normally secondary to the function of the building and so not typically suited to a structure of architectural appeal.

Due to the component based manufacturing method of assembly that the Polyform Folding Building System employs, the advantages of the above established methods of prefabricated construction have been combined with a new system of inter connecting components to enable an almost completely factory based manufacture of the finished building that can be easily packed for delivery and reassembly, thereby overcoming many of the previous difficulties of transport and installation.

SUMMARY OF INVENTION

The present invention provides a portable building assembly comprising a plurality of sections comprising:

- floor, wall, ceiling and roof sections;
- a Sliding End Wall component;
- a Sliding Rotating Roof Panel connection;
  - a Roof Load Bearing Beam connection and Wall Section Removal;
  - a Rotating Concrete Slab Connection Bracket; and
- a Customised Infill Panel (CIP).
  - wherein said sections are suitably adapted to be folded in a collapsible state and transported to be erected at a building site as required.

Preferably, the Sliding End Wall component allows the end wall section to slide backwards out of its flat packed transport position and rotate 90 degrees into its final upright position.

Preferably, the Sliding Rotating Roof Panel connection allows a roof panel to slide and pivot upward from its flat packed position to create roof structures of any form.

Preferably, the Roof Load Bearing Beam connection and Wall Section Removal allows various design layouts to be accommodated across standard sections by incorporating a Roof Load Bearing Beam into a Wall/Roof connecting plate to create openings between individual standard sections by removing wall sections to a required length, allowing articulation of form and incorporate a variety of construction components.

Preferably, the wall, ceiling and roof components are connected to a traditionally constructed concrete slab by means of a Rotating Concrete Slab Connection Bracket.

Preferably, the assembly allows connection of a mechanical fastener through the Bracket into the concrete slab.

Preferably, the wall support sections may be removed to allow installation of the Customised Infill Panel.

Preferably, modular sections are fitted to allow customization such as extension and reduction of the building.

Preferably, the assembly further comprises connector plates wherein the components allow floor wall and roof components to be fixed in place during transport, preventing collision between panels.

Preferably, upon installation, each plate has a fixed position that locks floor wall and roof components to their final position once erect.

Preferably, the plates are interlocking or interconnecting.

Preferably, the plates are both the actuating elements for the folding mechanism and the structural elements holding the floor, wall, ceiling and roof together.

Preferably, the assembly further comprises an internal lining wall clip to enable all electrical hydraulic and communications services for the house to be pre-installed and simply connected to services by suitably qualified persons after the main structural installation is complete.

Preferably, the assembly is lifted in one motion for each section by means of lock and lift assembly bracket.

Preferably, the assembly further comprises a single infill panel which is cut to measure and then fitted into a steel frame once erected.

Preferably, the assembly further comprises a gutter section that is configured to be pre-installed into the roof.

Preferably, the assembly further comprises an interior/exterior clip on a lining system that allows wall sheets to be pre-fitted and removed as needed to gain wall access.

In another aspect, the present invention provides a method of constructing and installing a building assembly comprising the following steps:

interconnecting a range of articulate components including floor, wall, roof and ceiling connectors; and locking said components into place upon erection by lifting of the assembly in a single motion.

Preferably, according to the method above, the assembly is lifted by means of a Lock and Lift assembly bracket.

DESCRIPTION OF THE INVENTION

The Polyform Folding Building System solves many of the above mentioned limitations by utilising a range of adaptable articulating Floor, Wall, Ceiling and Roof connections. These connections allow the Floor Wall Ceiling and Roof components to be pre positioned and constructed together in a factory environment, prefinished with electrical hydraulic and other services fitted and then packed down efficiently. The structure once packed down can be delivered to site in a flat packed form most efficient for transportation.

The system is also fully adaptable to almost any traditional building form. Various roof types including but not limited to Hip, Gable, Skillion, with eaves and without and other variations are able to be constructed using the system. Various standard typical building forms can be reproduced with the system including multi level construction. At any time the standard components can be modified to allow extensions and adaptations to existing structures. The system also allows full disassembly and relocation of the Building at any time.

The adaptability of the standard sections means that the manufacturer is able to construct a large number of standard components at one time without having to customise components to suit a specific design.

This means that manufacturing operations can minimise material waste and capitalise on the advantages of large scale production runs.

The standard components can be assembled in a wide range of variations to suit the individual customers requirements once an order has been placed, delivering an aesthetically pleasing building at a significantly lower cost.

Once built to meet the clients brief at the factory, the building can be transported to site in flatpack form and re-erected simply by articulating the floor wall ceiling and roof components. The interconnected components ensure that the finished internal and external finished floor, wall and roof components can be re-aligned perfectly to their previous positions with a small and relatively low skilled labour force and minimal lifting equipment.

The Polyform Folding Building System panel connections allow Floor, Wall, Ceiling and Roof components to be fixed in place during transport and then lifted in sequence by means of a Lock and Lift transit bracket. This prevents collision between panels and damage to the finished panel surfaces during transport and installation and also ensuring that building sections can be lifted and erected safely and efficiently.

As the building sections are installed, each interconnected component has a fixed position that locks into place once erect, ensuring floor wall ceiling and roof components are installed in a safe manner at all times.

The interconnected components are both the articulating elements for the folding mechanism and the structural elements holding the Floor, Wall, Ceiling and Roof together. As such the connecting points may be engineered to withstand both the dead load and uplift forces experienced by buildings.

These connections may be inspected in the factory before the building is delivered to site, removing the need for site frame inspections in certain cases.

The Polyform Folding Building System is manufactured from typical construction materials including but not limited to steel, timber, masonry and composite products. Frames would more typically be constructed from light gauge steel materials; however timber masonry and composite frames could also be used as required.

Articulating components would typically be manufactured from steel or other suitable materials and fastened in a range of mechanical manufacturing methods, including but not limited to screwing, riveting and welding operations.

The Polyform Folding Building System can be delivered to the construction site by means of traditional delivery methods such as truck trailer, shipping container or other type of transport in flat packed sections.

Installation Stages

Insert here

The key elements of the Polyform Folding Building System are noted below:

1. Sliding Rotating End Wall component
2. Sliding Rotating Roof Panel connection.
3. Roof Load Bearing Beam connection and Wall Section Removal.
4. Rotating Concrete Slab Connection Bracket.
5. Customised Infill Panel (CIP).
6. Load and Lift Bracket.
7. Detachable wall lining clip.
8. Mechanically actuated erection.

The part description of the main components of the Polyform Folding Building System is included below:

1. Roof Sheeting
2. Roof Sliding Rotating Pivot Point
3. Roof structural member
4. Roof Rotating Apex Plate
5. Ceiling structural member
6. Detachable Lower Wall structural member
7. Detachable Upper Wall structural member
8. Floor Structural member
9. Upper Wall Mid Point Rotating Connector Plate
10. Lower Wall Mid Point Rotating Connector Plate
11. Detachable Floor to Wall Rotating Connector Plate
12. Detachable Wall to Floor Rotating Connector Plate
13. Detachable Wall to Ceiling Rotating Connector Plate
14. Ceiling to Roof and Wall Rotating Connector Plate
15. Pre Installed Gutter
16. Roof Sliding Joint
17. End Wall Sliding Joint
18. End Wall Rotating Joint
19. End Wall Sliding Bracket
20. End Wall Sliding Bracket Vertical Locking Point
21. Floor Substrate
22. End wall MidPoint connection Bracket
23. End Wall Lower Structural Member
24. End Wall Upper Structural Member
25. Load Bearing Beam
26. Load Bearing Beam Connection Point
27. Connection locator hole
28. Fixed Roof Pivot Point
29. Plate to Structural Member Mechanical Connection Point
30. Diminishing Roof and Valley Hinge Point
31. Diminishing Roof Lateral Structural Member
32. Diminishing Roof Nesting Member
33. Diminishing Roof Perimeter Structural Member
34. Diminishing Roof Apex Connection Bracket
35. Concrete Slab
36. Concrete Slab Rotating Connection Bracket
37. Lower Wall Horizontal Structural Member
38. Concrete Slab Connection Mechanical fastener
39. Customised Infill Panel (CIP ©)
40. Deleted Wall Structural Members
41. Detached Floor to wall connector Plate
42. Concrete Slab Connection Bracket Pivot Point
43. Concrete Slab Connection Bracket Fastening Point
44. Standard Section Flat pack
45. Transit Lock and Lift bracket
46. Typical erect building section
47. Detachable wall section
48. Typical flat packed building section
49. Concrete Slab Connection Bracket Clearance
50. Mechanical fasteners
51. Lock and Lift Bracket D shackle lifting point
52. Lock and Lift Bracket upper floor connection point
53. Lock and Lift Bracket Roof connection point
54. Lock and Lift Bracket Ceiling Connection point
55. Lock and Lift Floor Connection Bracket (Lower)
56. Diminishing roof assembly
57. Polyklip parts A and B—Interlocking detachable wall lining clip
58. Opposing interlocking tooth
59. Mechanical Actuator
60. Typical erect wall section
61. Typical erect roof section The key elements of the invention are described below:

Sliding Rotating End Wall Component.

The sliding and rotating connection allows the end wall section to slide backwards out of its flat packed transport position and rotate 90 degrees into its final upright position.

FIG. 1 shows a typical building flat pack section 48, packed for transport with floor 8, wall 6 and 7, ceiling 5, and roof 3, Rotating Connector Plates 4,9,10,11,12,13,14, locked in place, restricting the panels ability to rub against other components causing damage.

Figure 1:
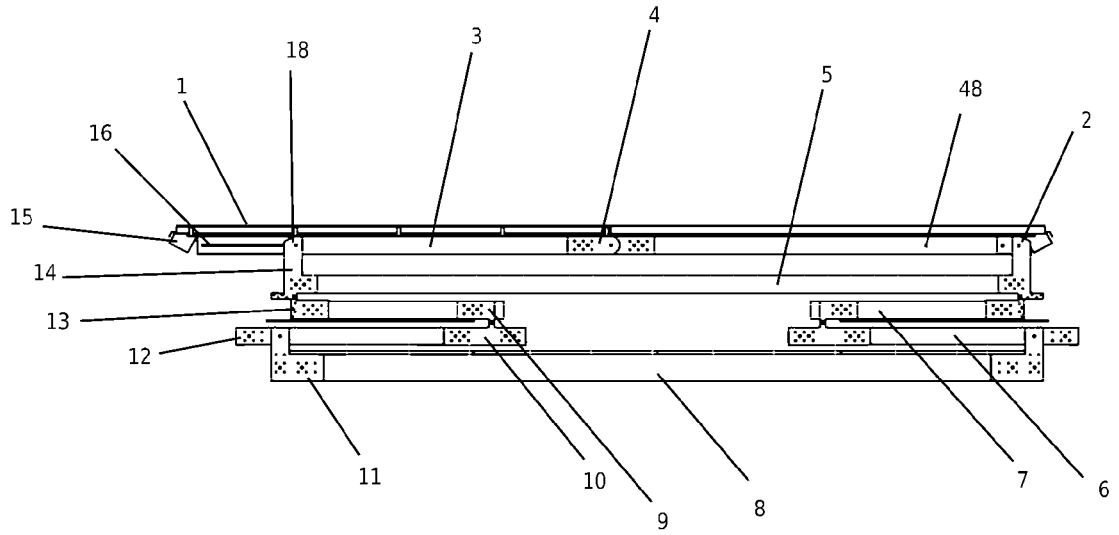
Figure 2:
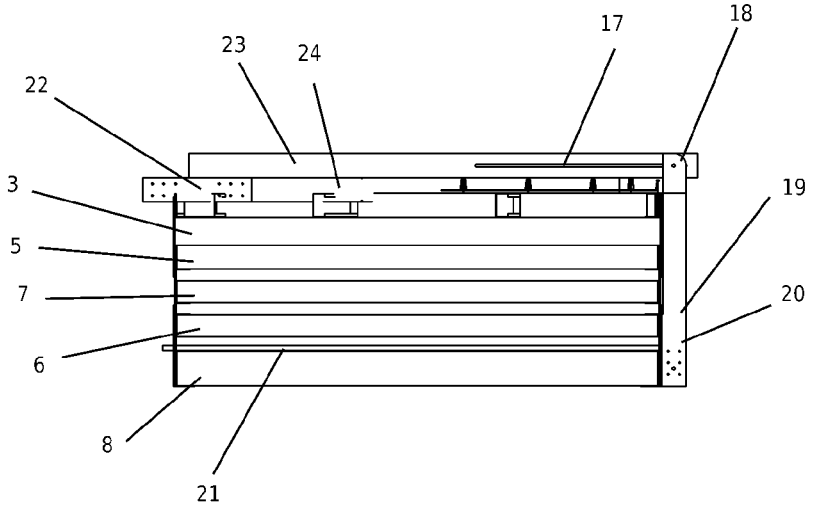
FIG. 2 shows a typical building end wall flat pack assembly packed for transport.
Figure 3:
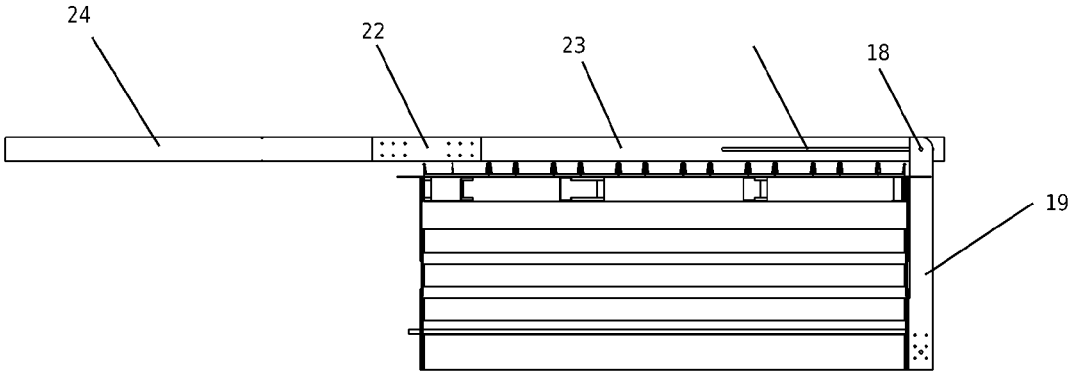
FIG. 3 shows the sliding end wall sections 24,23, connected with the with the End wall MidPoint connection Bracket 22, to form the complete end wall.
Figure 4:
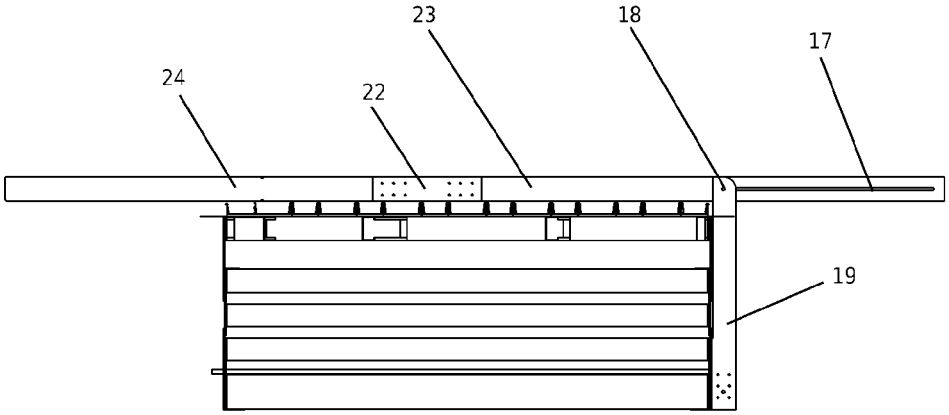

FIG. 4 shows the connected end wall 22,23,24, slid back to the extent of its sliding joint 17, ready to be rotated through the rotating joint 18, into its upright position.

Figure 5:
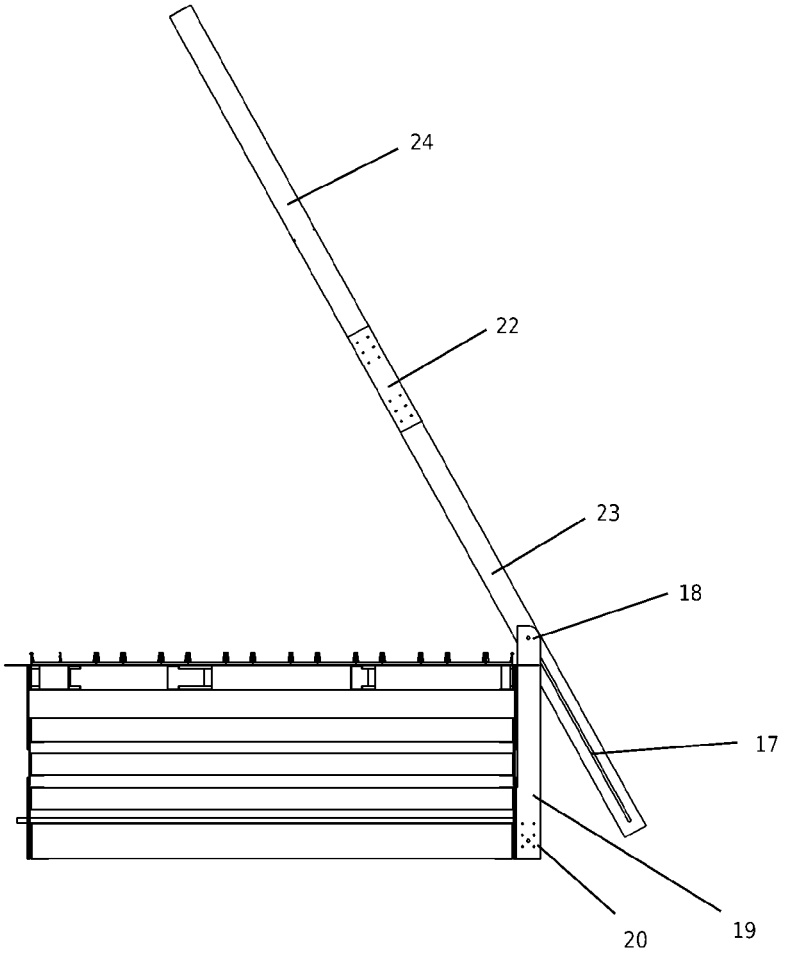

FIG. 5 shows the connected end wall section 24,22,23, fixed at its rotating point 18, rotating through 90 degrees to its final upright position.

Figure 6:
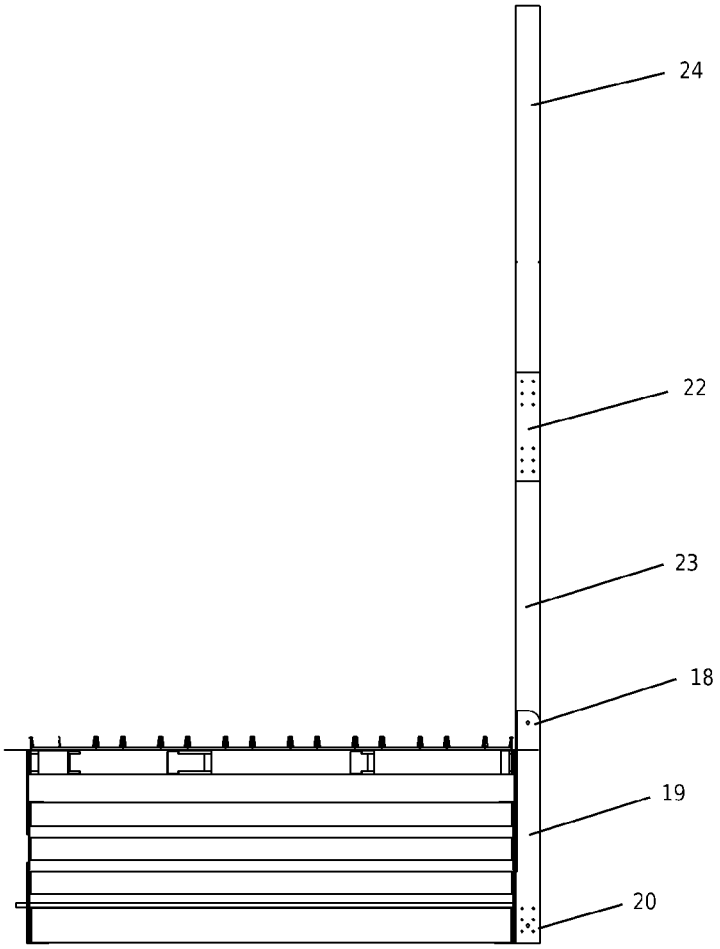

FIG. 6 shows the connected end wall section 24,23,22, in its final erect position, lower section secured with mechanical fasteners through the vertical upright locking position 20.

2. Sliding Rotating Roof Panel Connection

This connecting joint allows the roof panel to slide and pivot upward from its flat packed position to create roof structures of various forms.

The roof structure may incorporate an inbuilt gutter and a ridge cap, allowing the entire roof structure to be assembled together and weather sealed on the ground before the roof is lifted in one piece into position, removing the need for installers to work at height.

Figure 7:
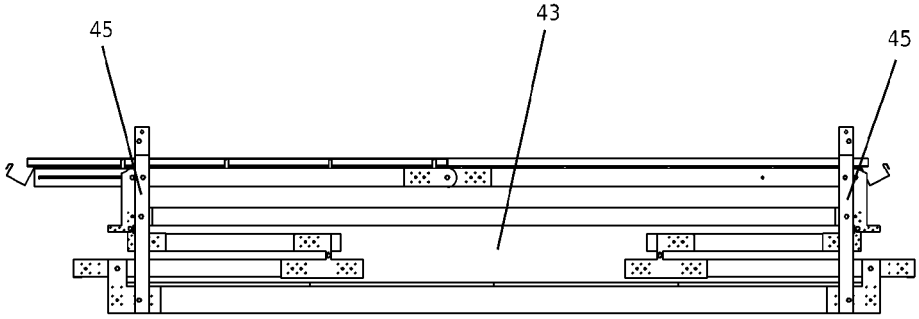

FIG. 7 shows the Standard Section Flat Pack delivered to site 44 with Lock and Lift brackets 45, engaged.

Figure 8:
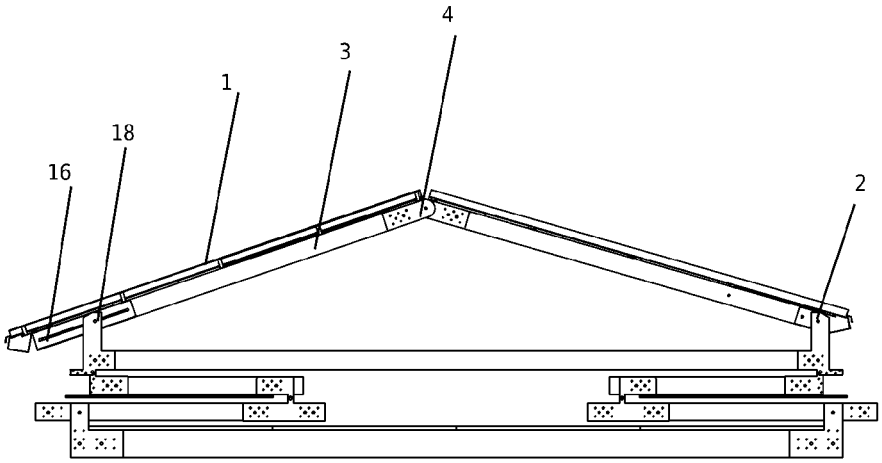

FIG. 8 shows the building Flat Pack with the roof members 1,3, being erected by articulating the panels through the Roof Sliding Rotating Pivot Point 18, along the Roof Sliding Joint 16, upward and inward pivoting at the Roof Rotating Apex Plate 4. The opposing roof rotating connection 2, remains fixed laterally but allows rotation of the roof section, comprising components 1,3,4,15.

Figure 9:
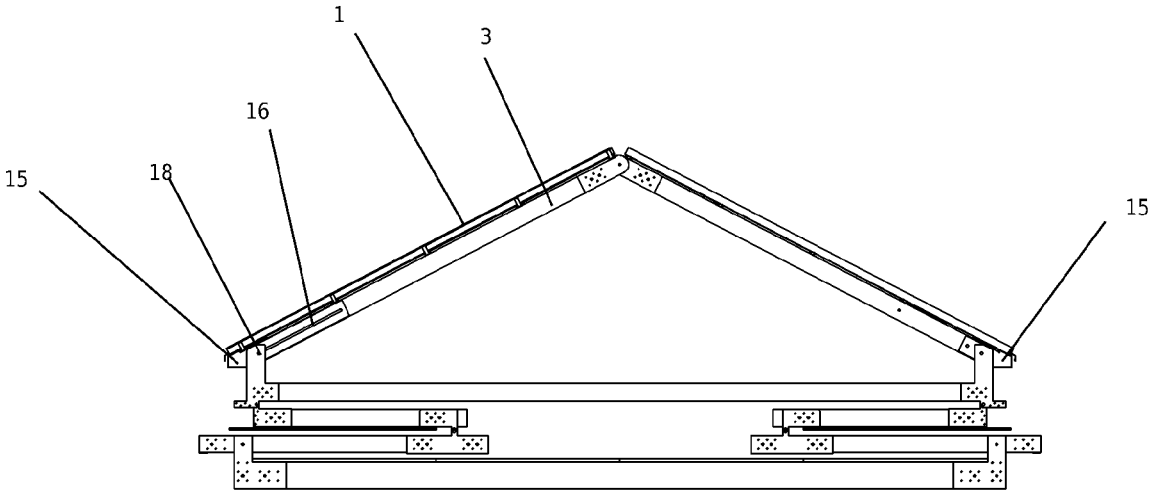

FIG. 9 shows the building kit with the roof and gutter sections 1,3,15 fully erect—sliding connection 16, articulated to its full extent and fastened in place into the sliding rotating connection 18, rotating section 2, fully rotated and fastened in place.

3. Roof Load Bearing Beam Connection and Wall Section Removal

Various design layouts can be accommodated across standard sections by incorporating a load bearing beam into the Wall/Roof connecting joint. The designer can create openings between individual standard sections by removing wall sections to a required length, allowing articulation of form and incorporation of a variety of construction components, such as Customised Wall Panels (CIP), windows, decks or doors.

Figure 10:
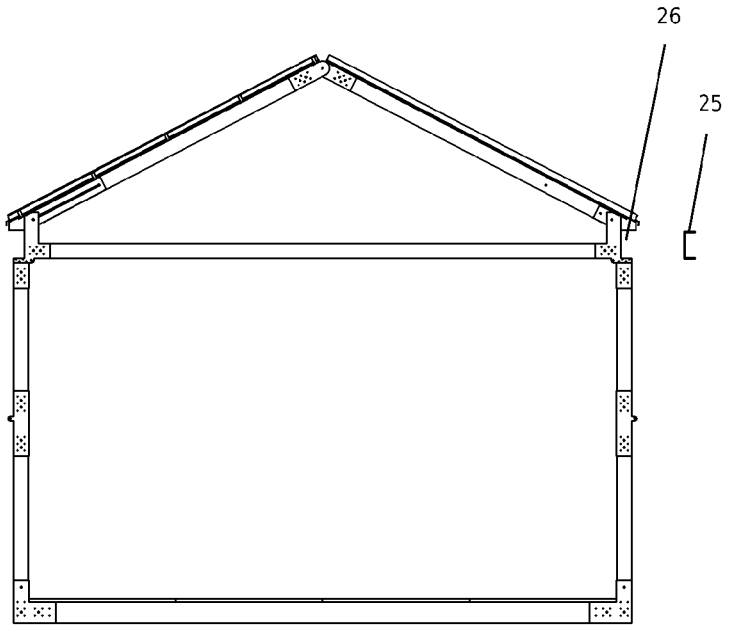

FIG. 10 shows the location of the load bearing connection bracket 14, and a load bearing beam 25, aligned with the void 26, ready to be installed.

Figure 11:
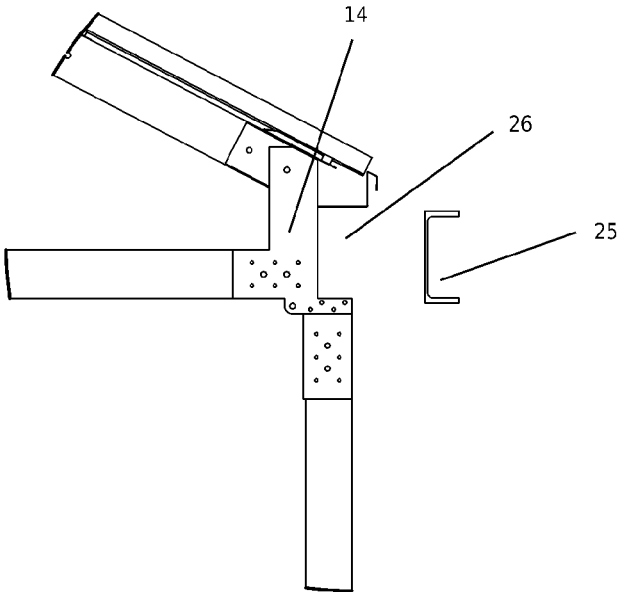

FIG. 11 shows the load bearing beam 25, aligned ready to be inserted into its recessed location 26, in the Ceiling to Roof and Wall Rotating Connector Plate 14.

Figure 12:
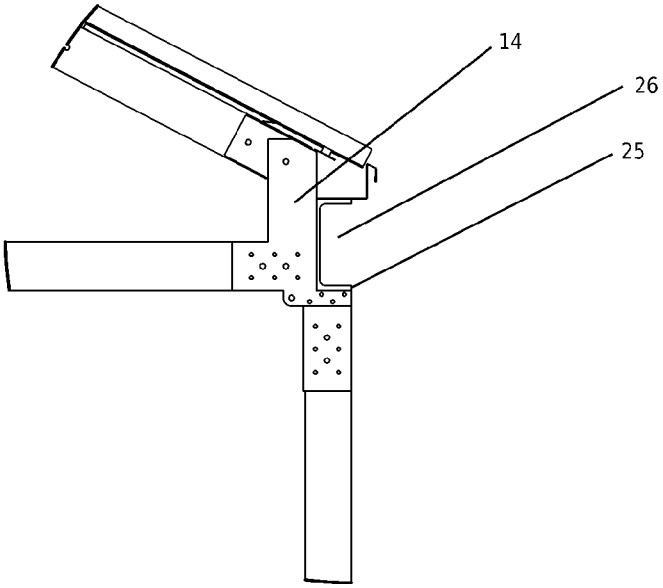

FIG. 12 shows the Load Bearing Beam 25, inserted into place into the void 26, in the Ceiling to Roof and Wall Rotating Connector Plate 14.

Figure 13:
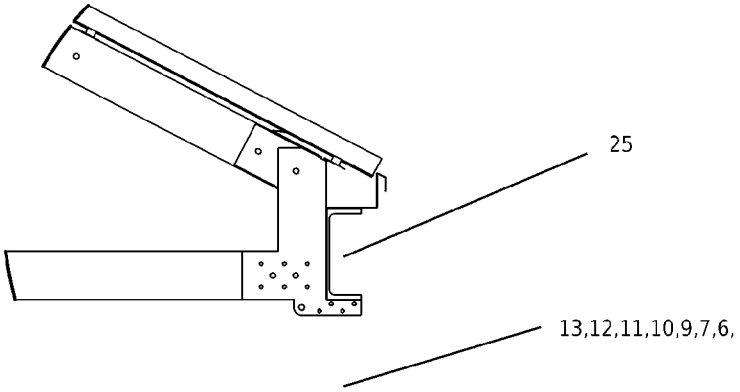

FIG. 13 shows the load bearing beam in place 25, with the subsequent wall sections 13,12,11,10,9,7,6 below now able to be removed.

Figure 14:
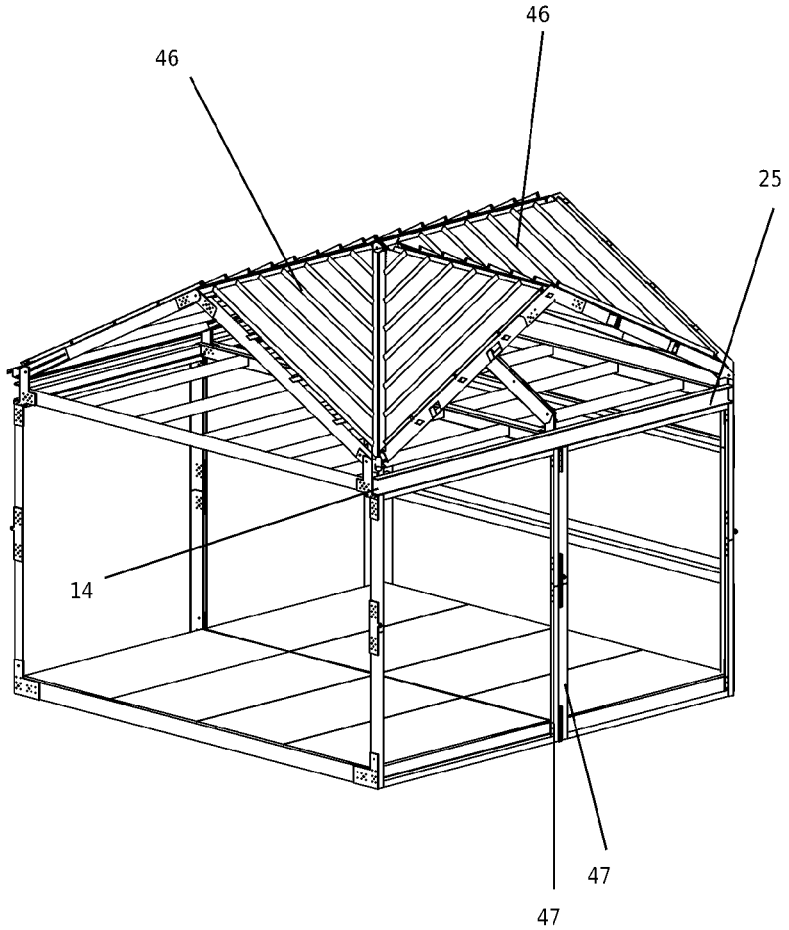

FIG. 14 shows two typical building sections 47, joined together with a load bearing beam 25, inserted into the housing void 26, in the Ceiling to Roof and Wall Rotating Connector Plate 14, above the Detachable wall section 47.

Figure 15:
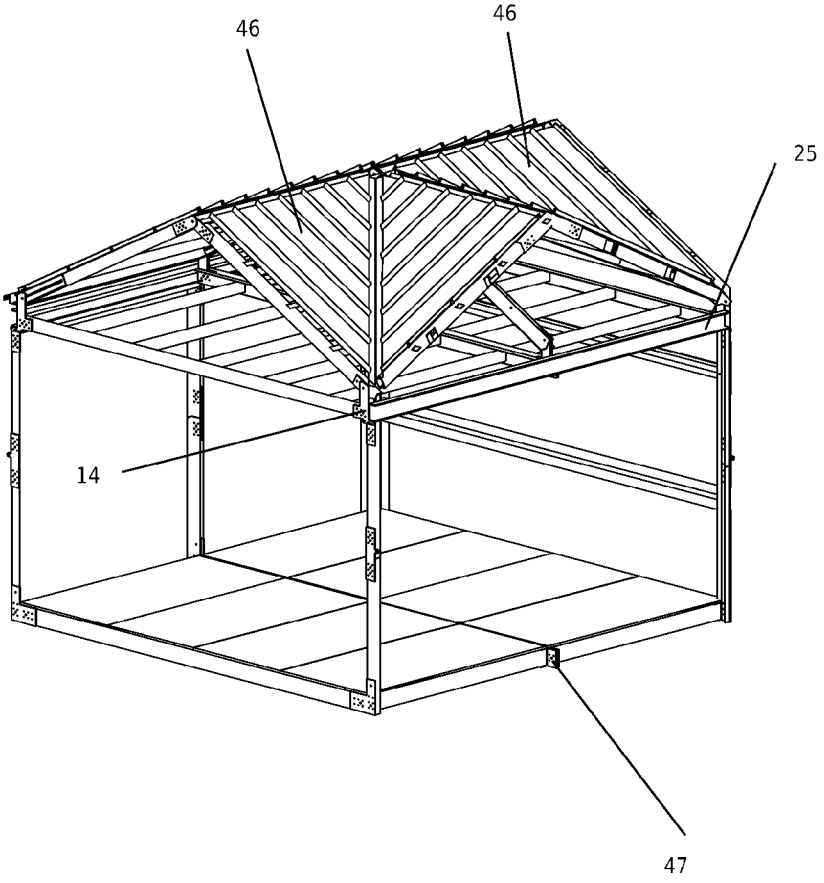

FIG. 15 shows two typical building sections 46, joined together with a load bearing beam 25, inserted in place into the Ceiling to Roof and Wall Rotating Connector Plate 14, with the Detachable wall section 47, removed to allow the articulation of form or the installation of various construction components such as other building sections 46, Customised Wall Panels (CIP ©) 39, windows or doors.

3A. Diminishing Roof Flat Pack Section

The Polyform Folding House design incorporates a method of flat packing diminishing roof sections that can be used to articulate multiple standard roof forms. For example, allowing the intersection of two ridge directions, a gable to gable section, created by joining two mirrored diminishing sections together, as shown in FIG. 15.

Figure 16:
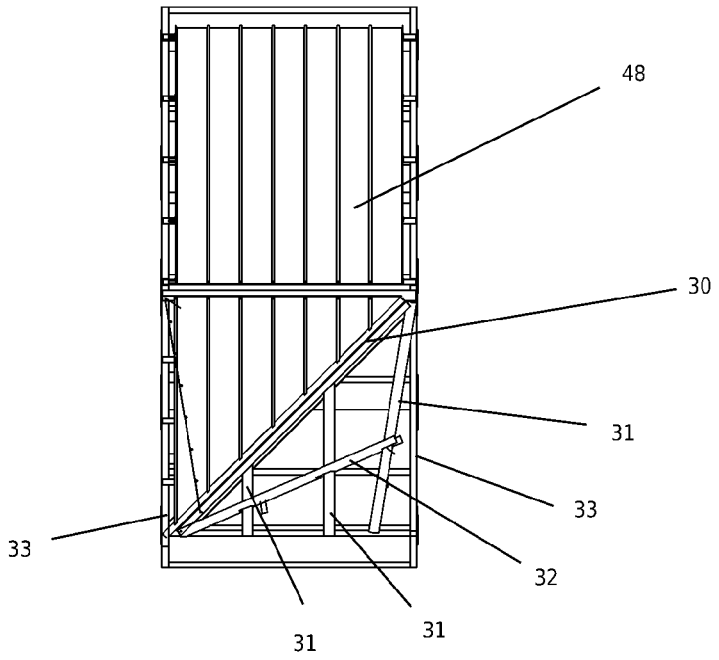

FIG. 16 shows a plan view of a flat packed diminishing roof section 48, with diminishing roof structural components 31,32,33, in their packed state.

Figure 17:
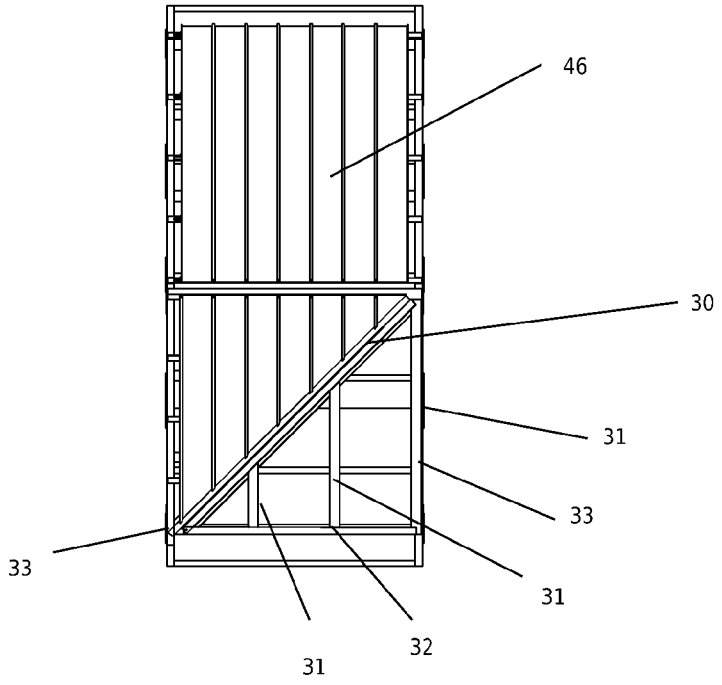

FIG. 17 shows an erected roof section 46, with diminishing roof components 30,31,32,33.

The diminishing roof structure is erected by moving the horizontal nesting component 32, upward and outward into position while the captured diminishing roof purlins 31, are guided into their final position to create a roof ridge and valley section 33,30.

Figure 18:
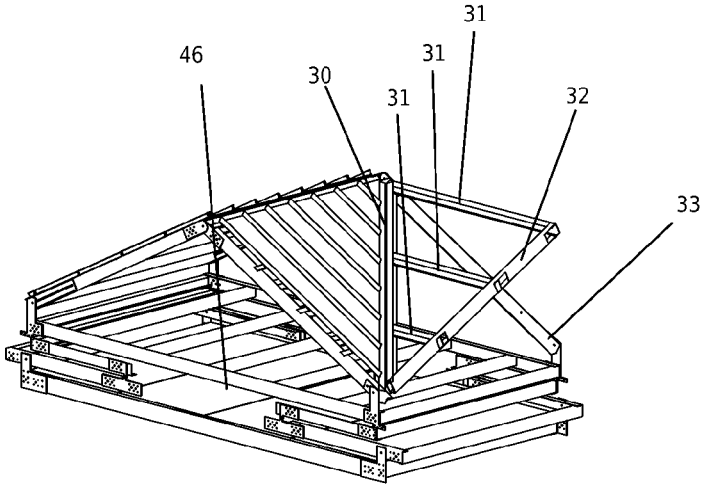

FIG. 18 shows the erect diminishing roof section with Structural roof components 30,31,32,33, in their final positions.

Figure 19:
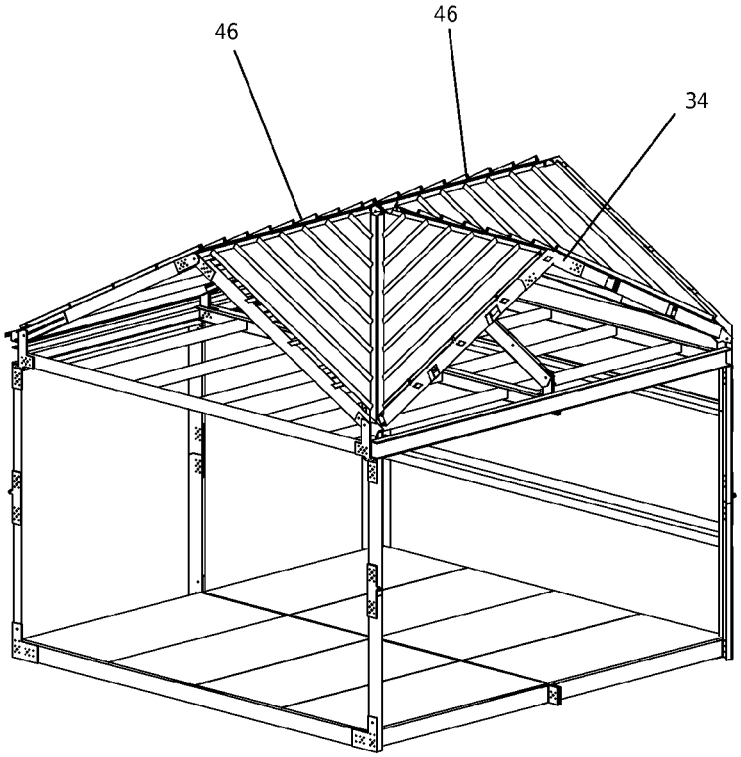

FIG. 19 shows two typical diminishing roof sections 46, connected together with a diminishing roof connection bracket 34, to create a standard gable roof diminishing intersection.

Figure 20:
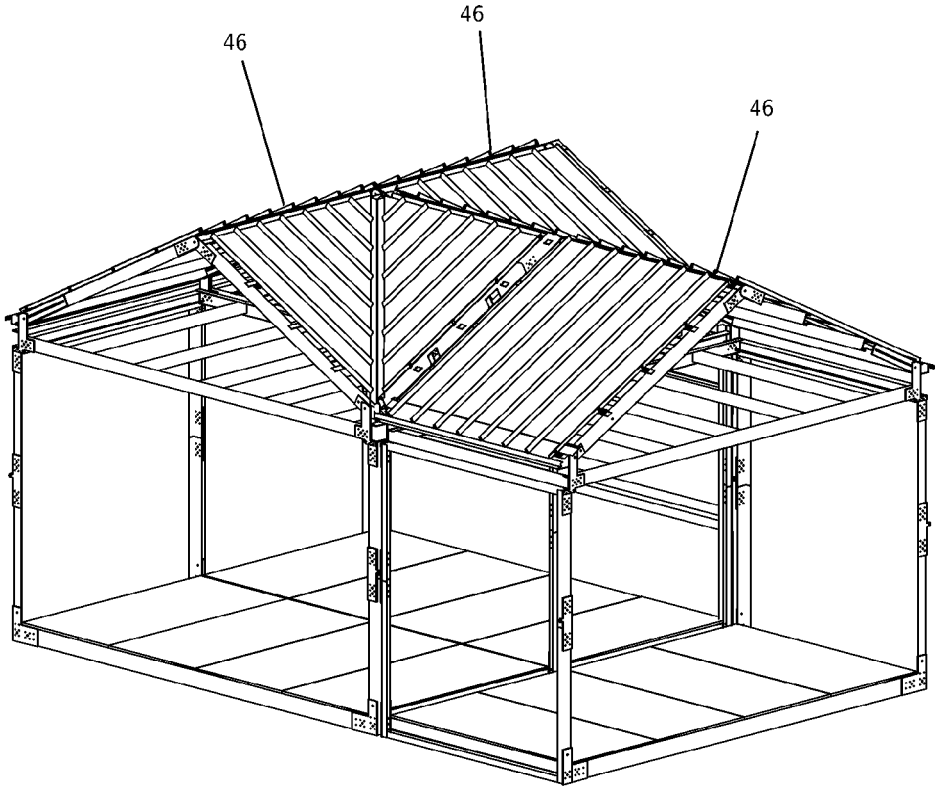

FIG. 20 shows a third standard building section 46, added to the assembly to demonstrate the continuation of a possible roof form.

4. Rotating Concrete Slab Connection Bracket

Each individual Floor, Wall, Ceiling and Roof section of the Polyform Folding Building System may be used independently of the other sections or in a variety of combinations with existing construction elements.

In the below example the Wall, Ceiling and Roof components are connected to an in situ concrete slab by means of a Rotating Concrete Slab Connection Bracket.

Figure 21:
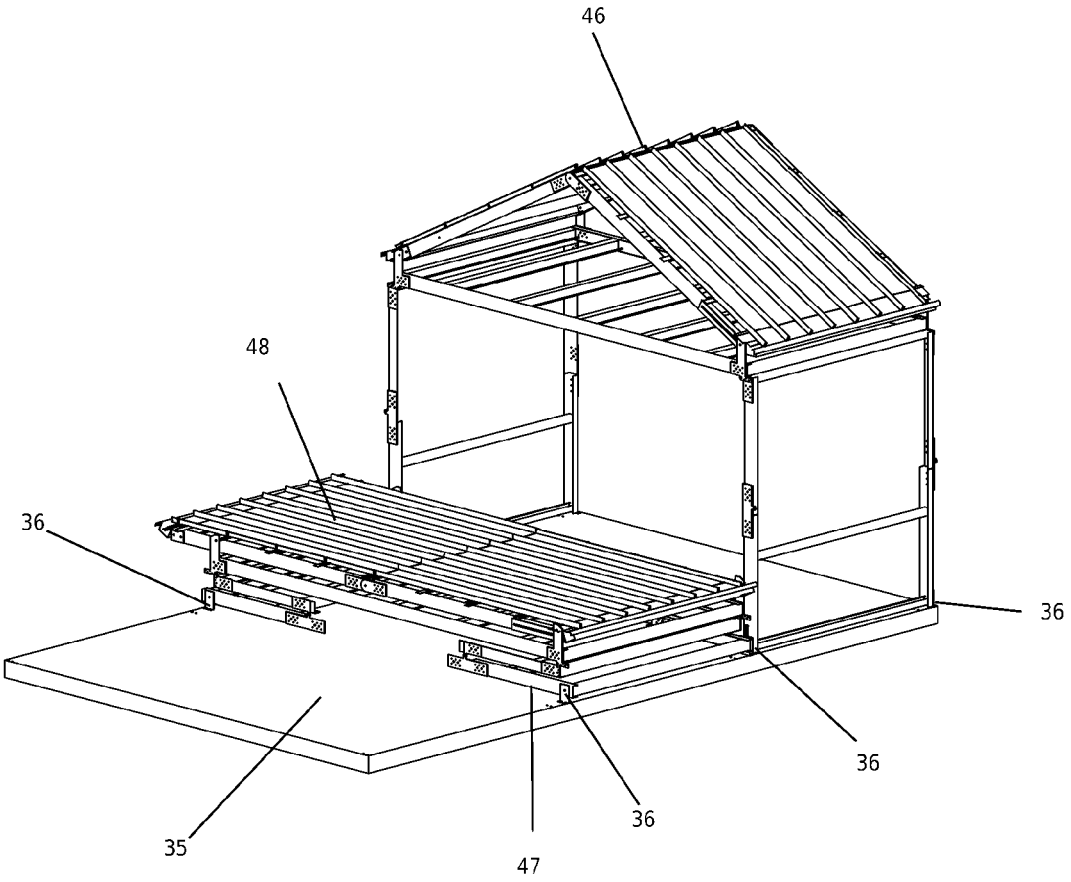

FIG. 21 shows two standard wall, ceiling and roof sections 46 and 48, being installed onto an existing concrete slab 35, through the Rotating Concrete Slab Connection Bracket 36, with mechanical fasteners 38. Once attached to the Concrete Slab, the building sections can be rotated into their erect position in the desired sequence. By attaching the assembled building sections to the concrete slab by means of the Rotating Concrete Slab Connection Bracket, the building components can be accurately placed onto an existing traditional slab structure 35, before erection.

The Rotating Concrete Slab Connection Bracket 36, is attached to the concrete slab with the required mechanical fasteners according to an engineer's specification.

The Rotating Concrete Slab Connection Bracket 36 is typically manufactured from folded plate steel with a hole or holes penetrating the lower flange to allow connection of a mechanical fastener through the Bracket into the concrete slab. It is typically mounted to the lower side of the Detachable wall section 47. The wall frame upright sections are mounted at a height that allows the wall frame to rotate 90 degrees from its flat packed position, into its upright position, without interfering with the concrete slab structure below.

Figure 22:
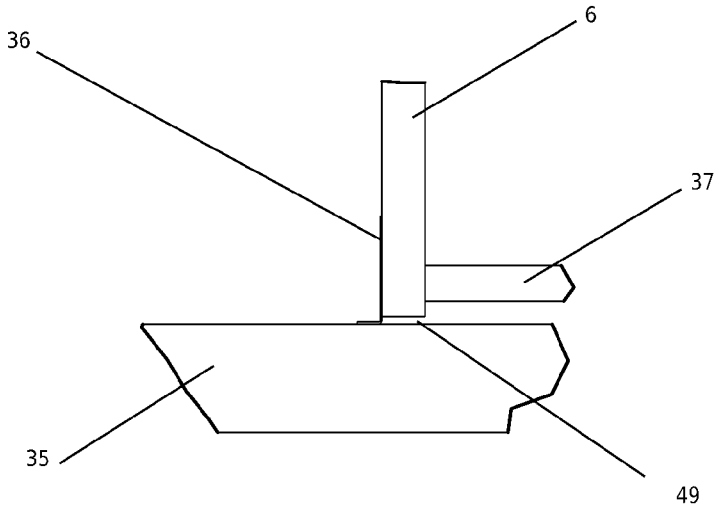

FIG. 22 shows the installation of the first building section 46, located onto the existing concrete slab 35, The concrete slab connection bracket 36, allows the building pack to be installed onto the concrete slab 35, in sections that are then connected to the slab by mechanical fasteners. Once one or more sections have been installed and are secured in place, they can be rotated into their erect positions, clear of interference with the concrete slab 35, because of the clearance provided in the bracket offset.

Figure 23:
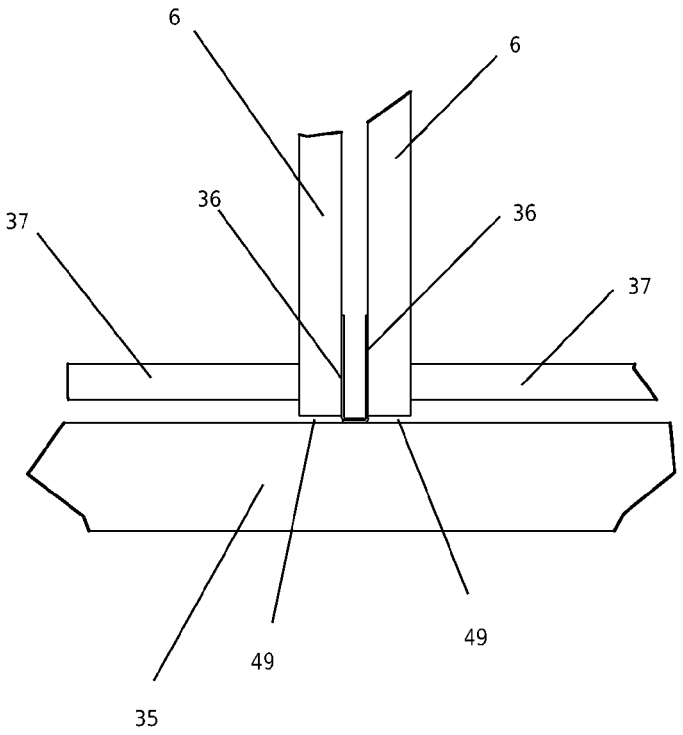

FIG. 23 showing a two typical building sections 46, with noted structural wall and connection brackets 6,35,36,37, installed in sequence. Concrete Slab Clearance noted on each section to allow rotation of each wall section.

Figure 24:
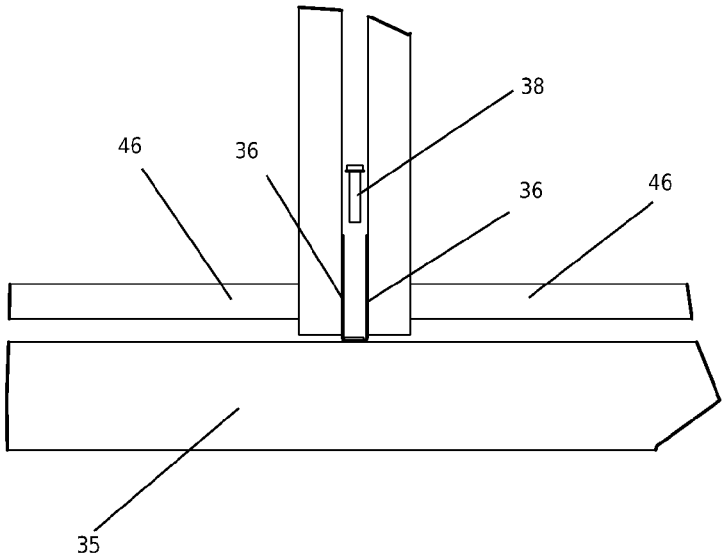

FIG. 24 shows a mechanical fastener 38, aligning with the left and right hand building sections 46 and Slab Connection Brackets 36.

Figure 25:
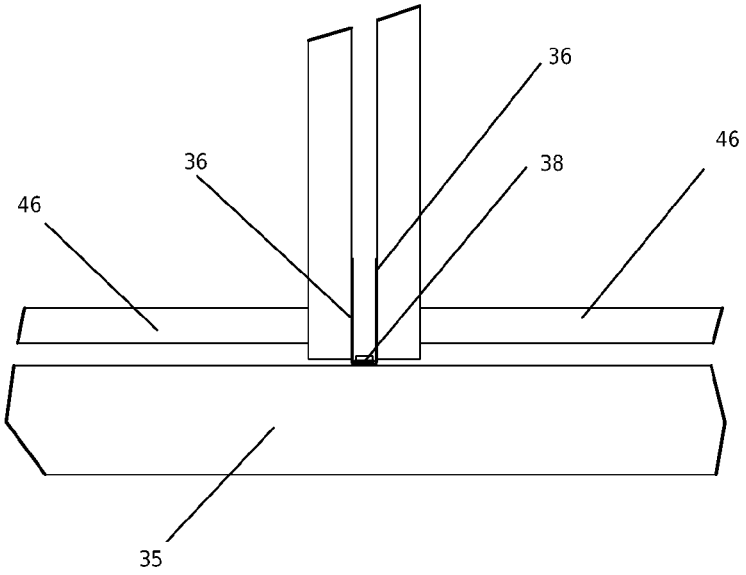

FIG. 25 shows the two building sections 46, in place with a mechanical fastener 38, installed through both Slab Connection Brackets 36, into the concrete slab 35.

Connecting the building sections 46, to each other and to the slab structure 35.

Figure 26:
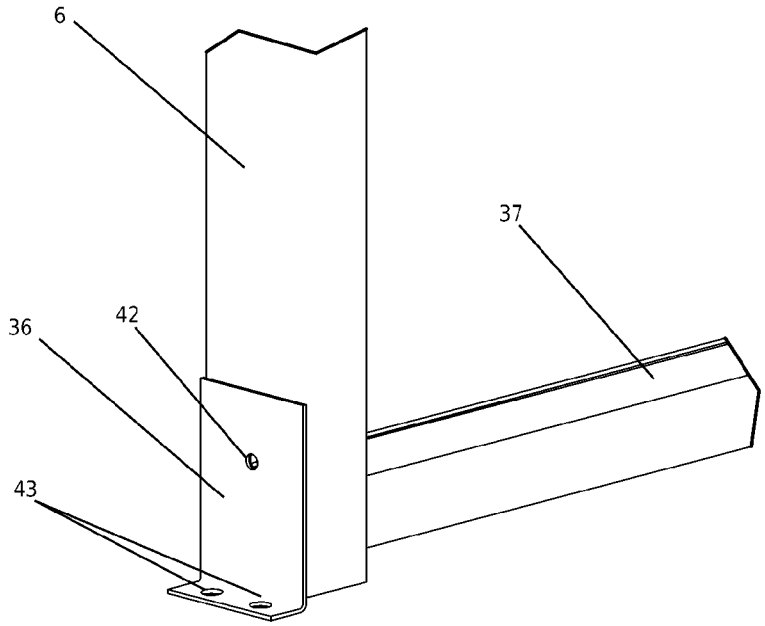

FIG. 26 shows the Concrete Slab Connection Bracket 36, with Concrete Slab Connection Bracket Pivot Point 42, and Concrete Slab Connection Bracket Fastening Point 43, including the lower wall structural member 6 and lower wall horizontal member 37 for clarity.

5. Customised Infill Panel (CIP ©)

Figure 27:
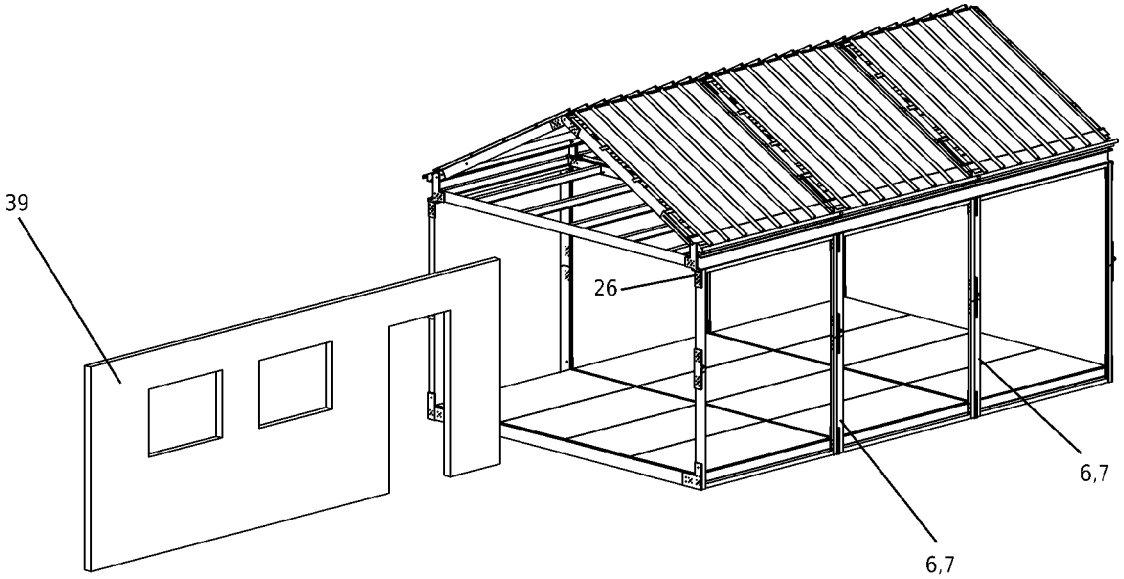

FIG. 27 shows a Customised Infill Panel (CIP ©) 39, assembled and ready to install into the erected building frame.

Overhead structural beam 25 is installed into Load Bearing Beam Void 26. Wall upright support sections 6 and 7 are removed to allow installation of the Customised Infill Panel (CIP ©) 39.

Figure 28:
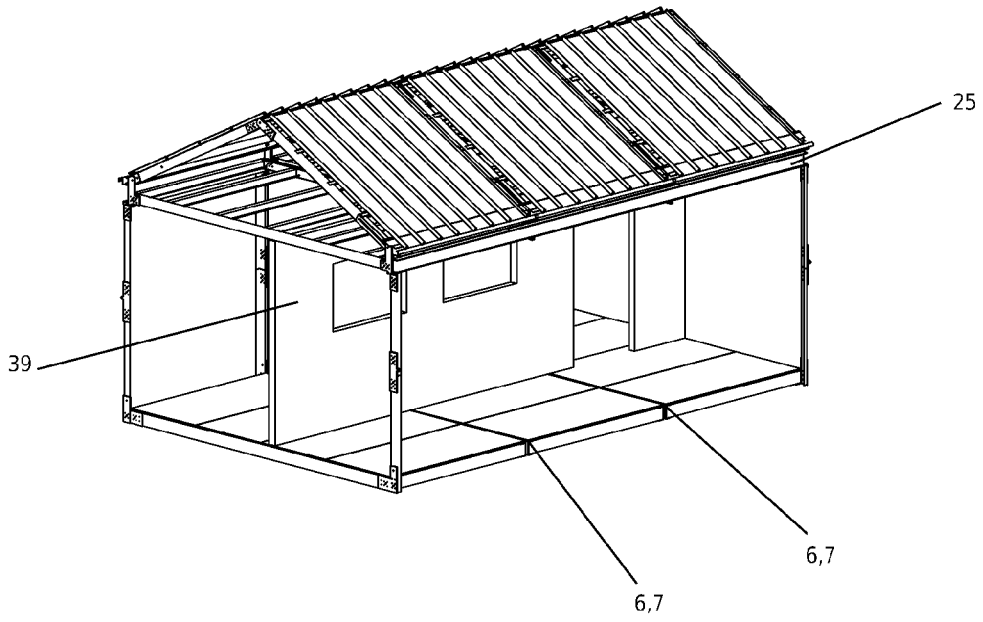

FIG. 28 shows a Customised Infill Panel (CIP ©) 39, installed into the erected building frame.

Load bearing support beam 25, installed into position in the Load Bearing Beam Void 26.

Wall support sections 6 and 7 removed to allow for installation of the Customised Infill Panel (CIP ©) 39.

Figure 29:
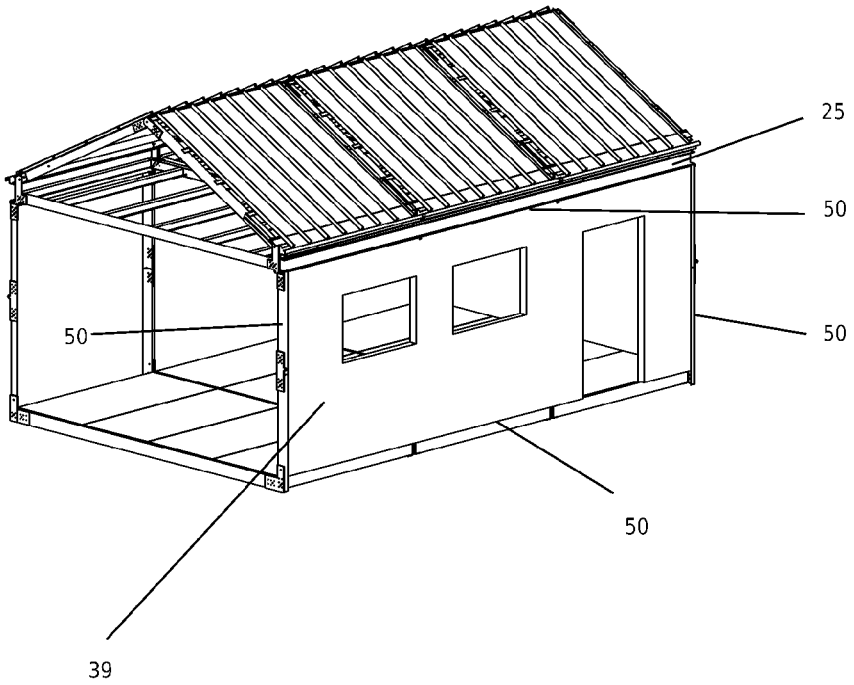

FIG. 29 shows Customised Infill Panel (CIP ©) 39, installed into its final location in the building frame, beneath the load bearing beam 25, fastened to perimeter of building frame using mechanical fasteners 50.

Figure 30:
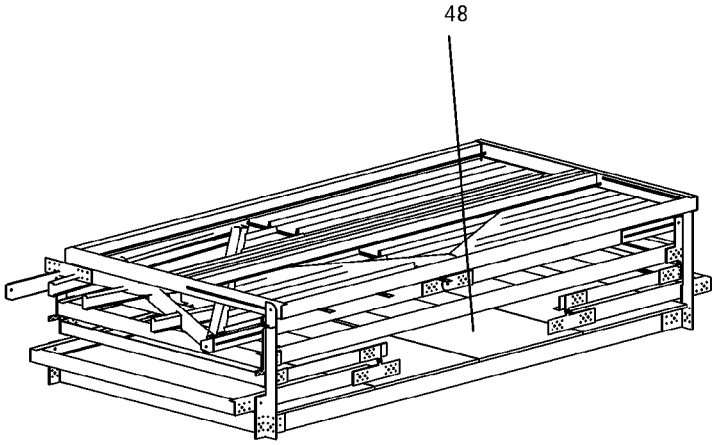

FIG. 30 shows a standard assembly sequence with a standard building pack 48, landed onto a foundation, ready to unpack.

Figure 31:
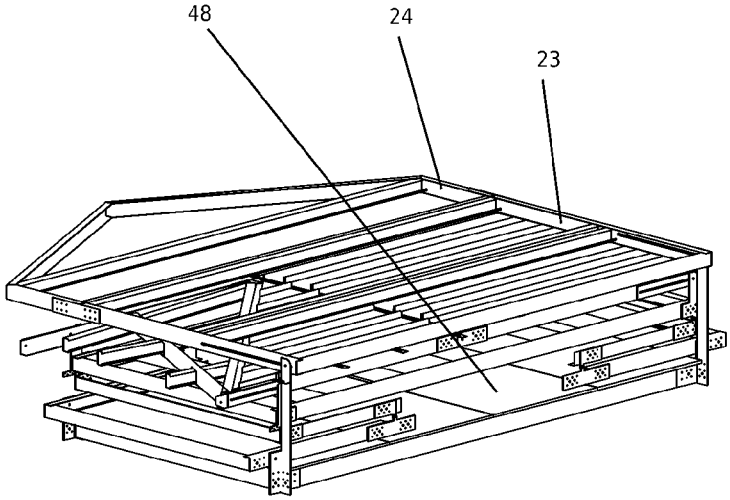

FIG. 31 shows the building pack 48, end wall section assembled 24,23.

Figure 32:
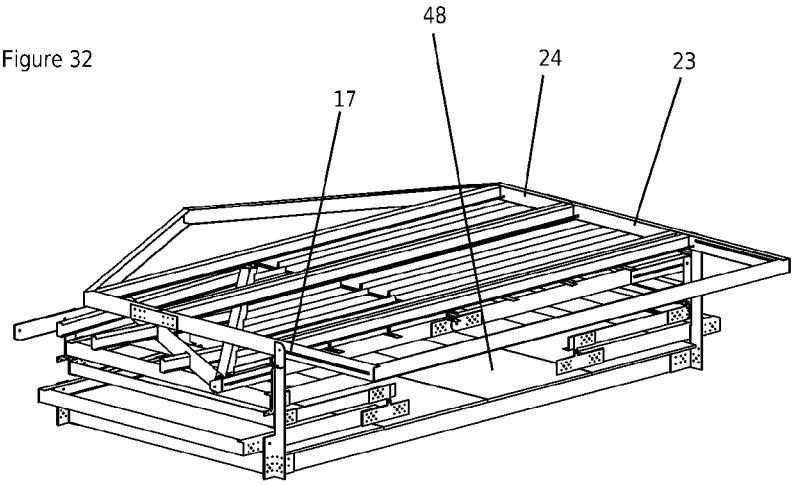

FIG. 32 shows the building pack 48, with the end wall section 24,23, slid back along sliding joint 17 into position.

Figure 33:
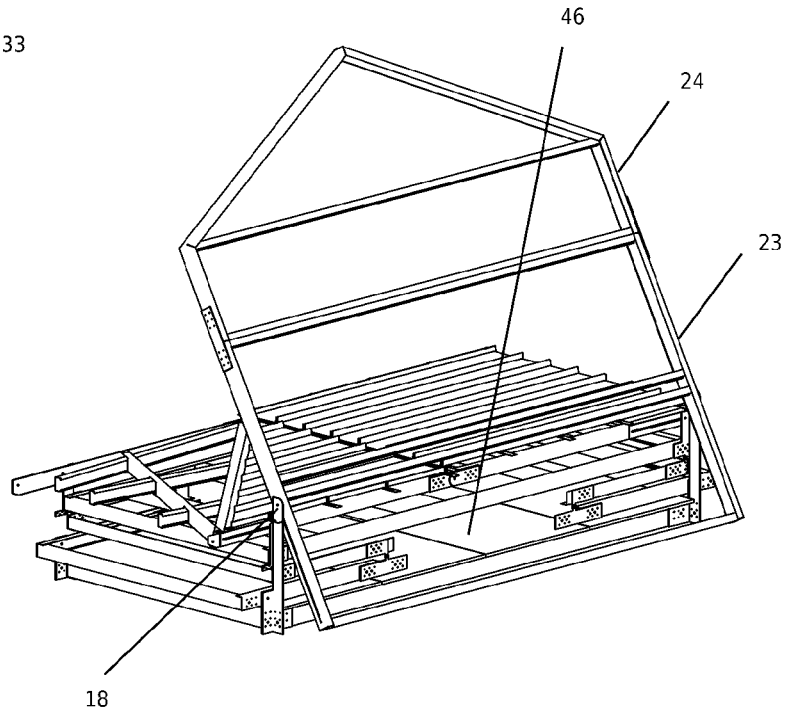

FIG. 33 shows the building pack 46, with the end wall section 24,23, rotating through the rotating pivot point 18, into position.

Figure 34:
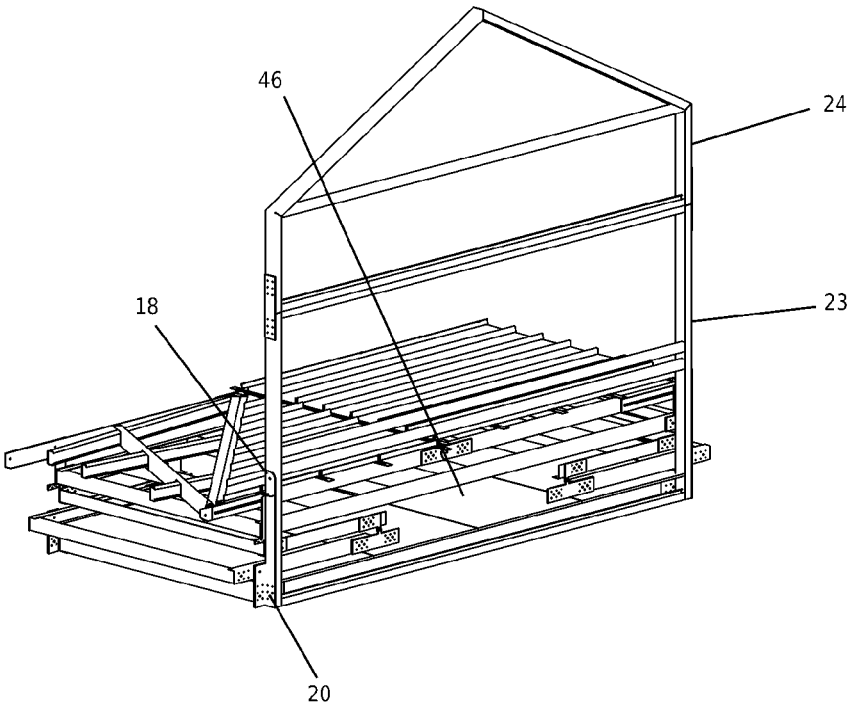

FIG. 34 shows the building pack 46, with end wall section rotated 90 degrees through the rotating pivot point 18, into its upright locked position 20.

Figure 35:
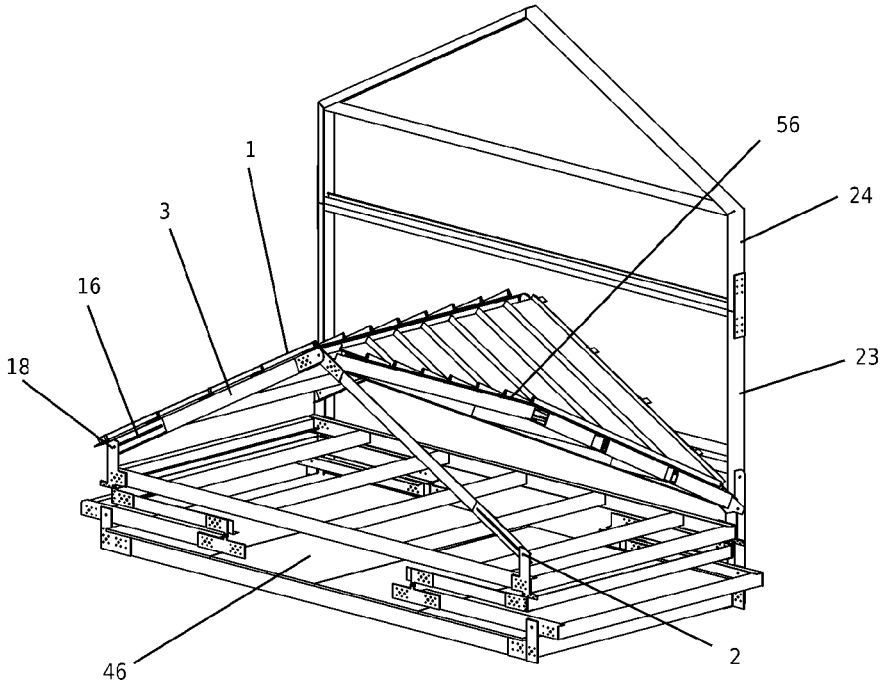

FIG. 35 shows the building pack 46, with the end wall section 24,23 in its fixed position. Sliding roof sections 1,3, erect, sliding and rotating roof connections 18,16,2 in their extended final locked positions.

Diminishing roof section 56, erect.

Figure 36:
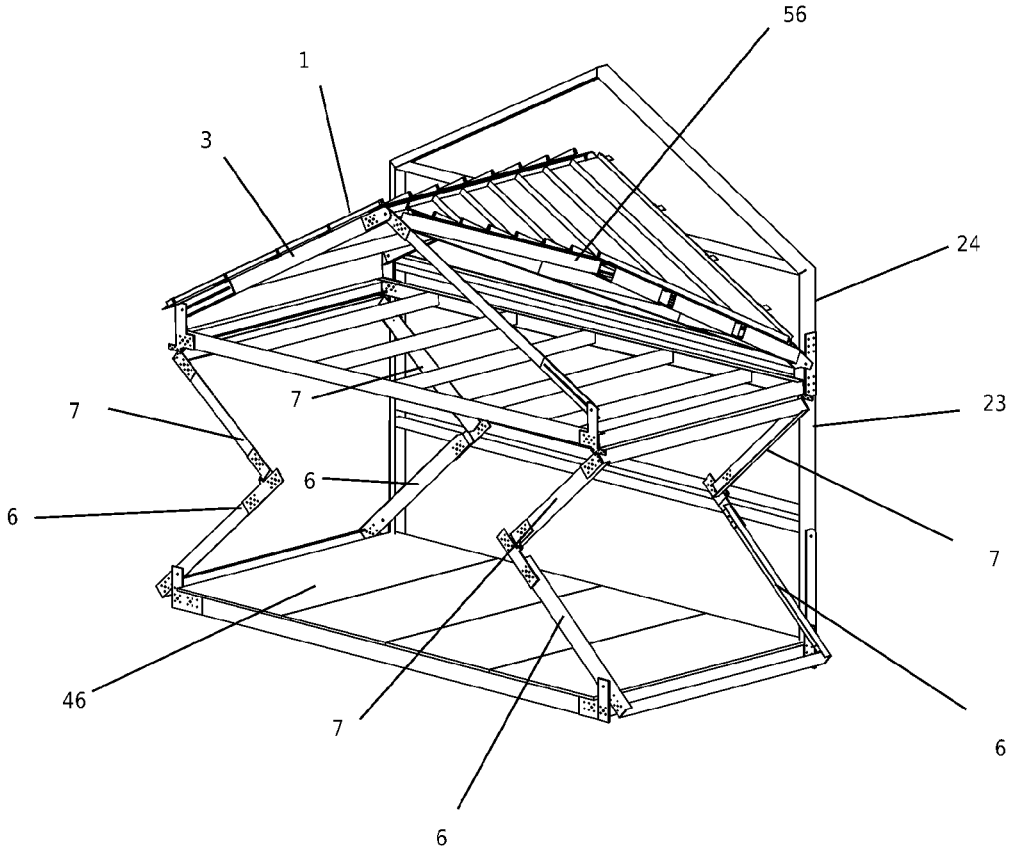

FIG. 36 shows building pack 46, with end wall 24,23 and roof sections 1,3 and diminishing roof section 56 locked in their final positions.

Wall sections 6,7 being lifted upward into position.

Figure 37:
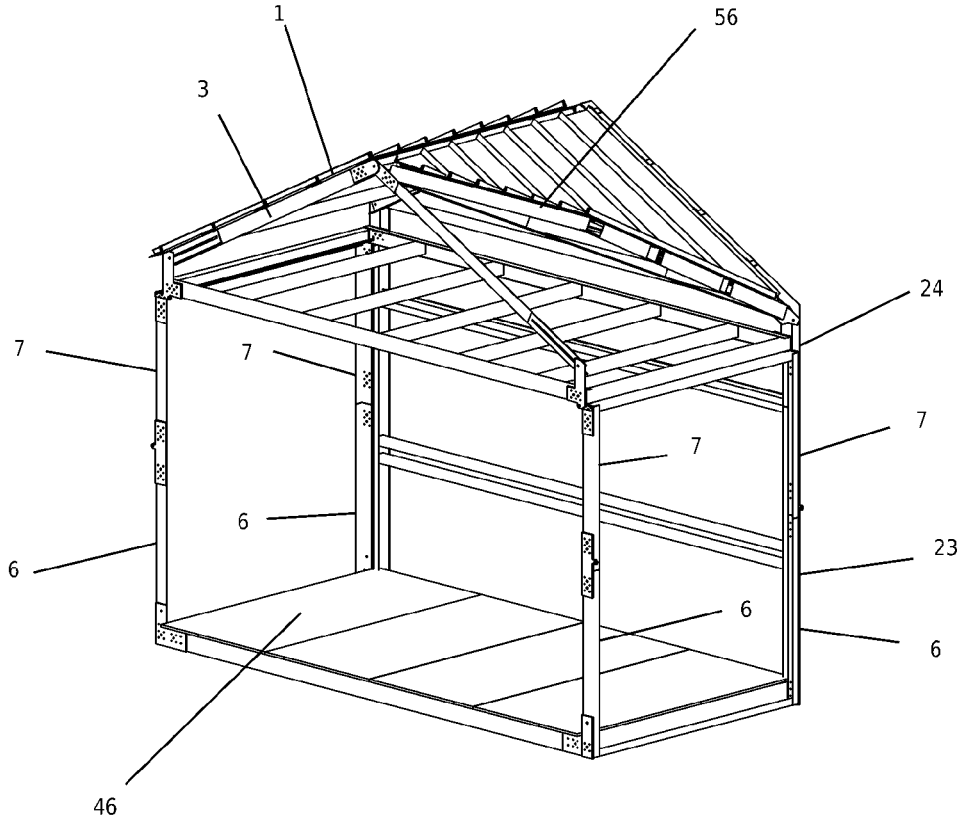

FIG. 37 shows building pack 46, fully erect. End wall section 24,23, roof sections 1,3,56, wall sections 6,7, in their final erect locked positions.

6. Lock and Lift Assembly Brackets

Figure 38:
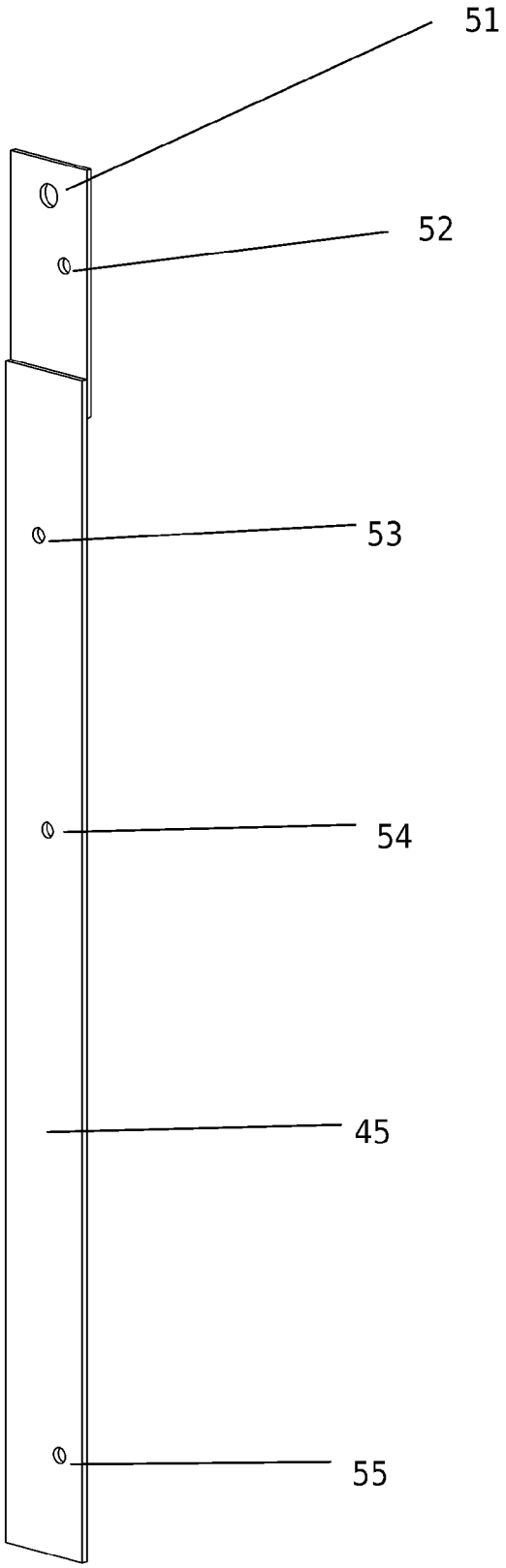

FIG. 38 shows a standard Lock and Lift assembly bracket 45, D shackle connection point 51, Floor bracket connection point (Upper) 52, Roof bracket connection point 53, Ceiling Bracket connection point 54, Floor bracket connection point (lower) 55.

Figure 39:
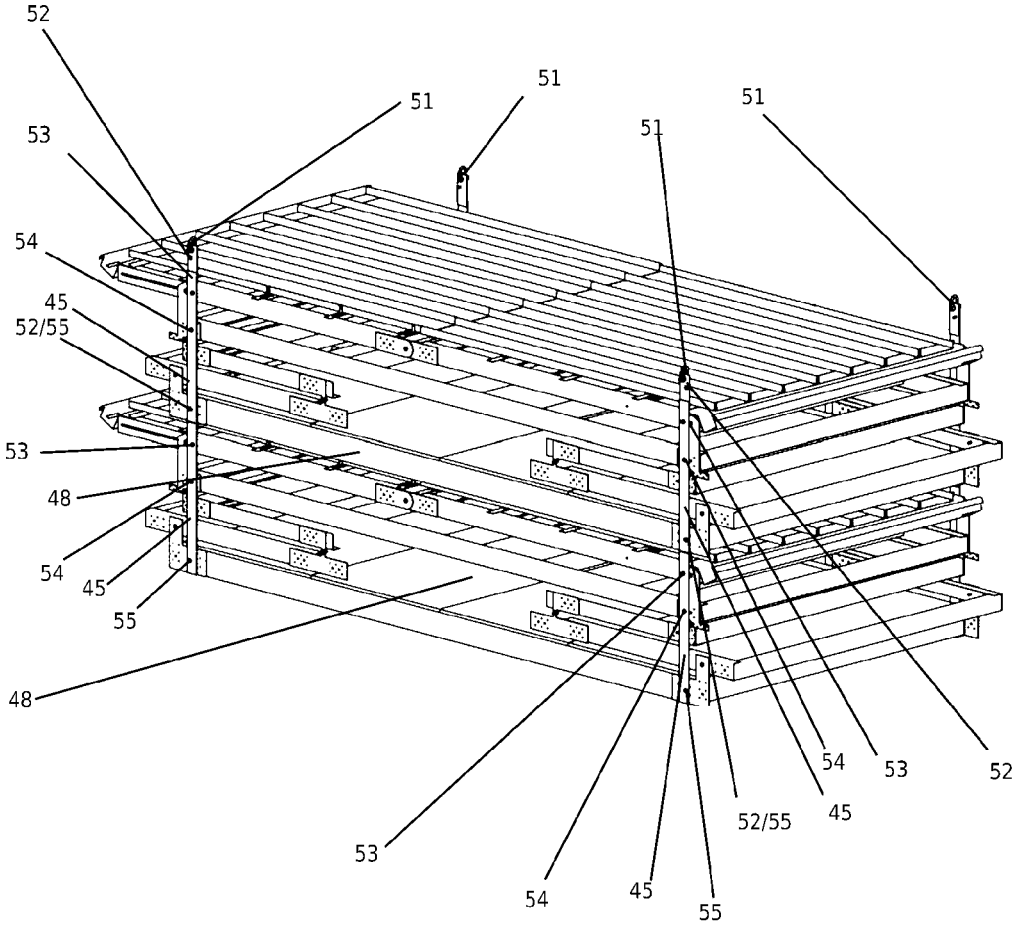

FIG. 39 shows two typical building packs 48, assembled for transit with the Lock and Lift assembly bracket 45. D shackle connection point 51, Floor bracket connection point (upper) 52, Roof bracket connection point 53, Ceiling bracket connection point 54, Floor bracket connection point (lower) 55.

Figure 40:
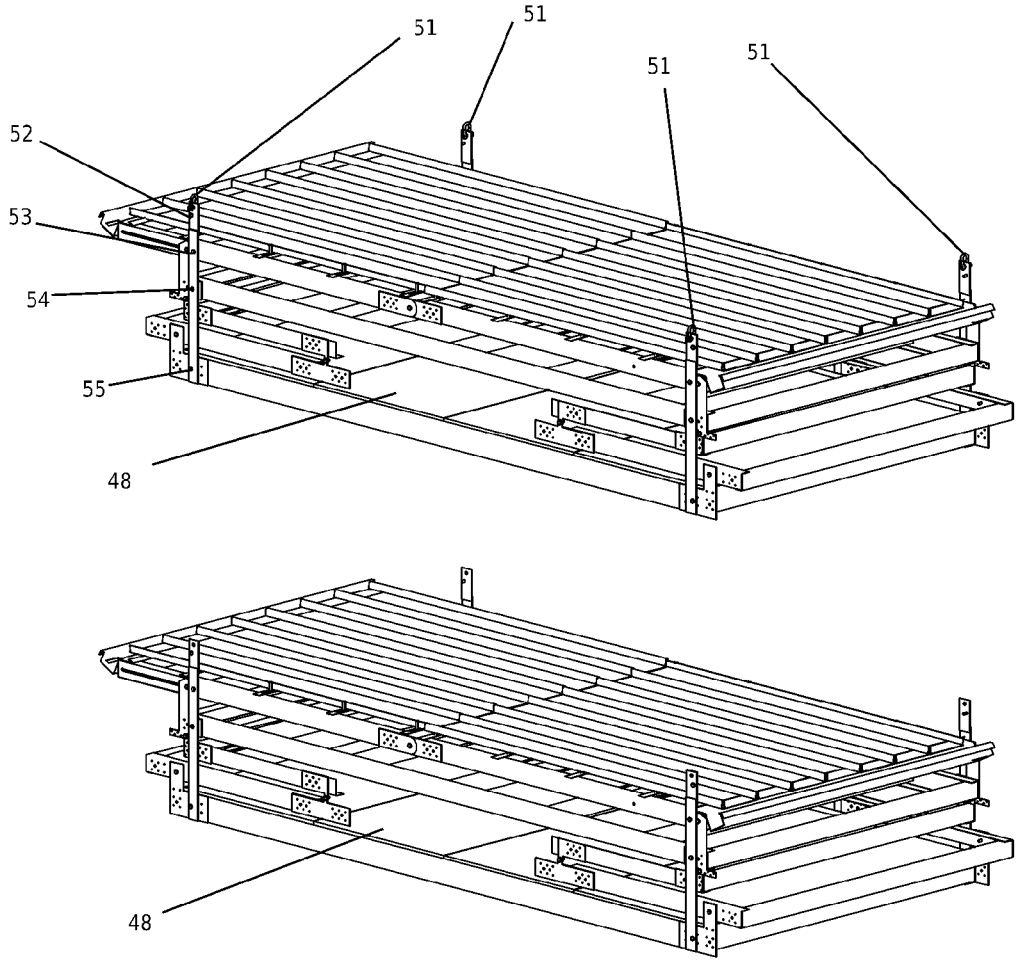

FIG. 40 shows two flat packed building sections 48, detached from the transport assembly shown in FIG. 39, and lifted by the d Shackle lifting points 51, one section at a time into their unique location in the building assembly. Roof 53, ceiling 54 and floor 55, sections are supported at their respective connection points.

Figure 41:
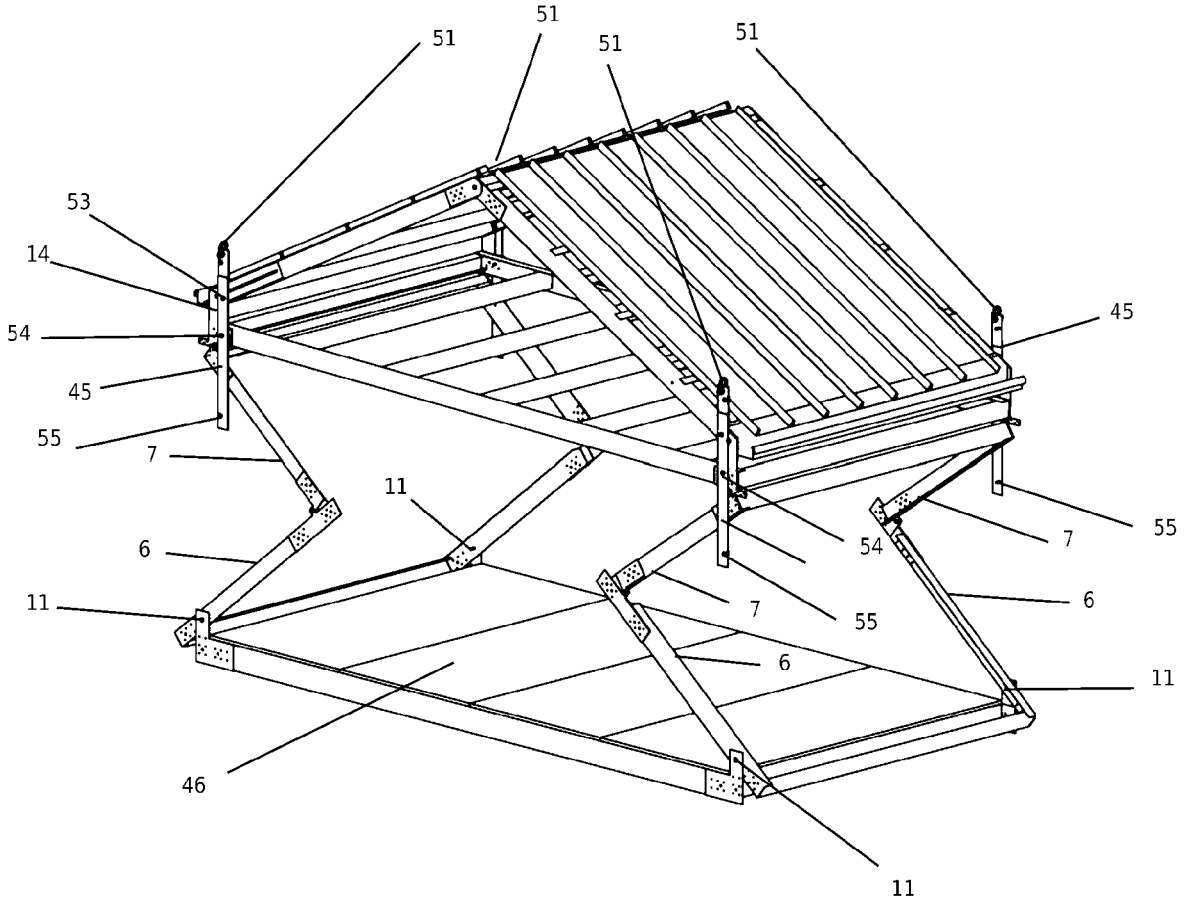

FIG. 41 shows a standard building section 46, being assembled using the Load and Lift assembly brackets 45. Roof connection point 53 has been detached from the roof to ceiling rotating connection bracket to allow the roof assembly sequence to be completed before the building pack is erected. Floor connection pint is detached from the Floor to wall rotation connection bracket 11, to allow wall sections 6 and 7, to articulate into their erect vertical aspect.

Ceiling connection points 54, remain connected until the lifting procedure has been completed, once wall sections 6,7, have been locked in their erect position, the ceiling connection points 54, of the Load and Lift brackets 45, are then detached and removed.

7. Detachable Wall Lining Clip

Figure 42:
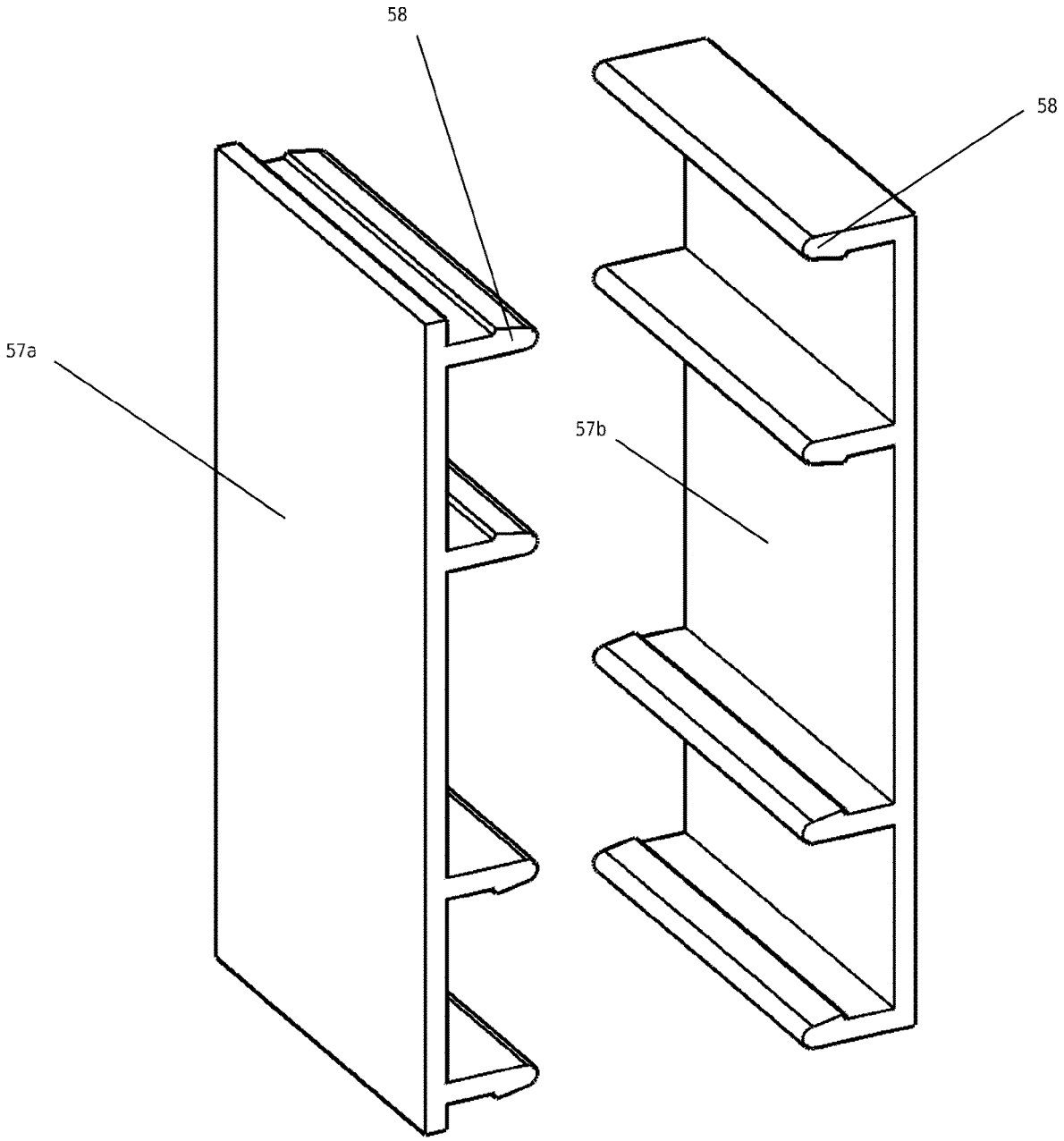

FIG. 42 shows a detachable wall lining fastening clip 57*a*,57*b*, with interlocking teeth 58, separated. The wall lining fastening clip is used to attach wall linings to the structural frame, allowing the wall linings to be pre installed at the factory, then removed for transport and installation and re installed once service connections (structural, electrical and hydraulic) have been completed. Wall lining clips are arranged on the wall lining material as required and fastened mechanically to both structural frame and lining.

Figure 43:
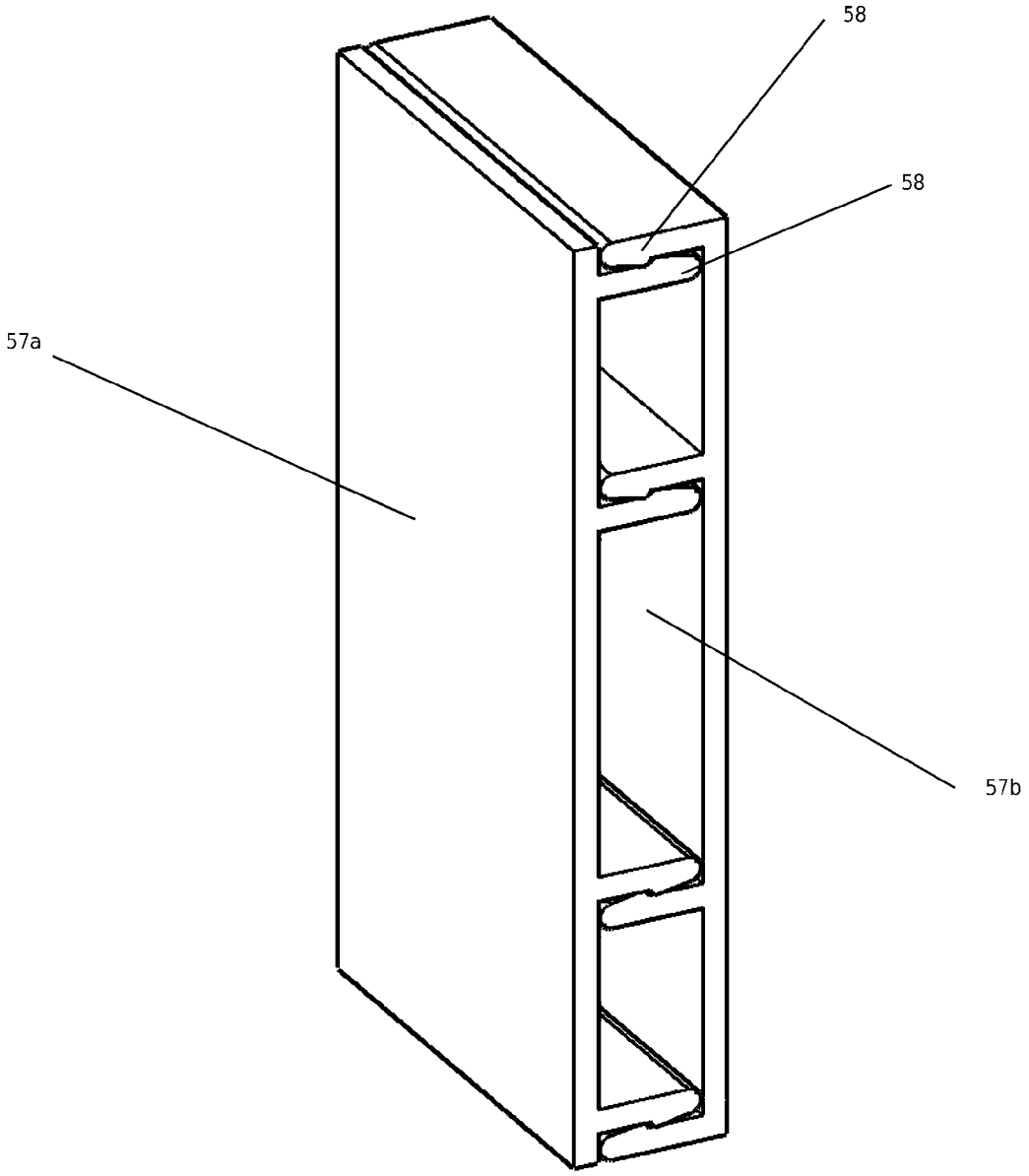

FIG. 43 shows an interlocking wall lining fastening clip 57*a*,57*b*, with interlocking teeth 58, connected.

8. Mechanically Actuated Roof and Wall Erection

Figure 44:
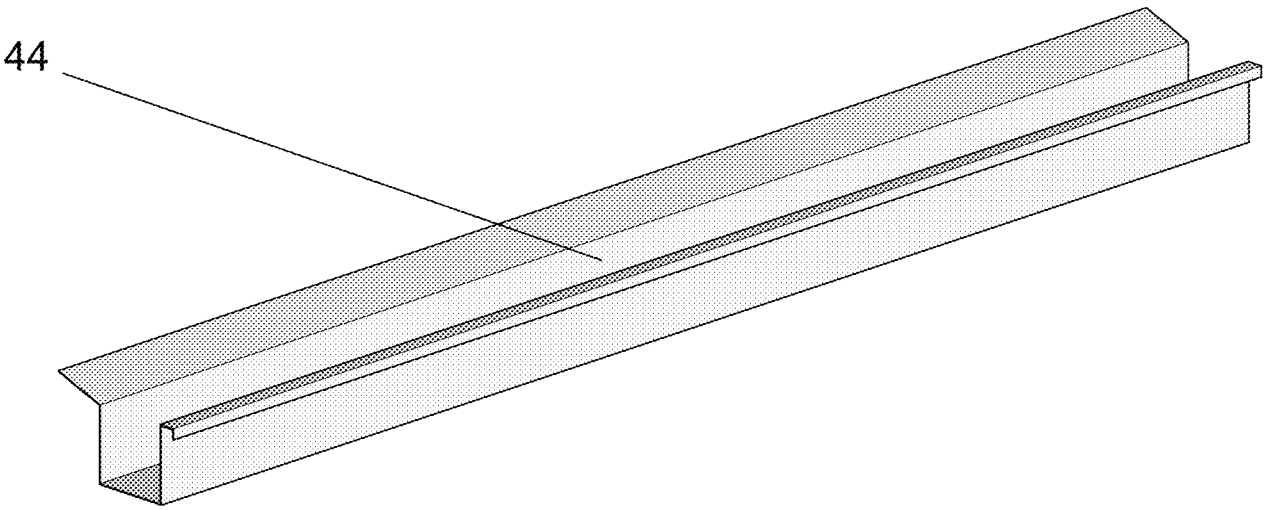

FIG. 44 shows a standard flat pack building section 44, before erection

Figure 45:
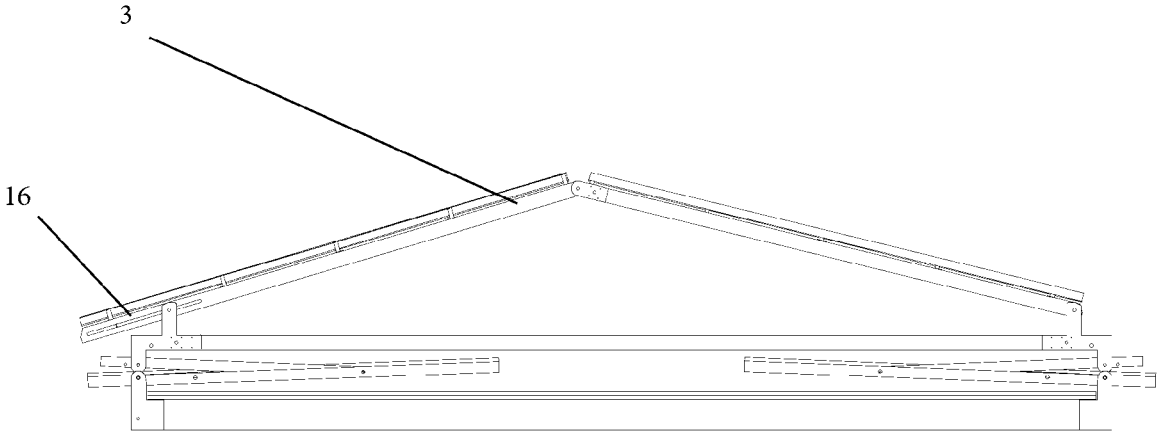

FIG. 45 shows a typical roof section with the structural roof member 3, articulating into position along the sliding roof joint 16

Figure 46:
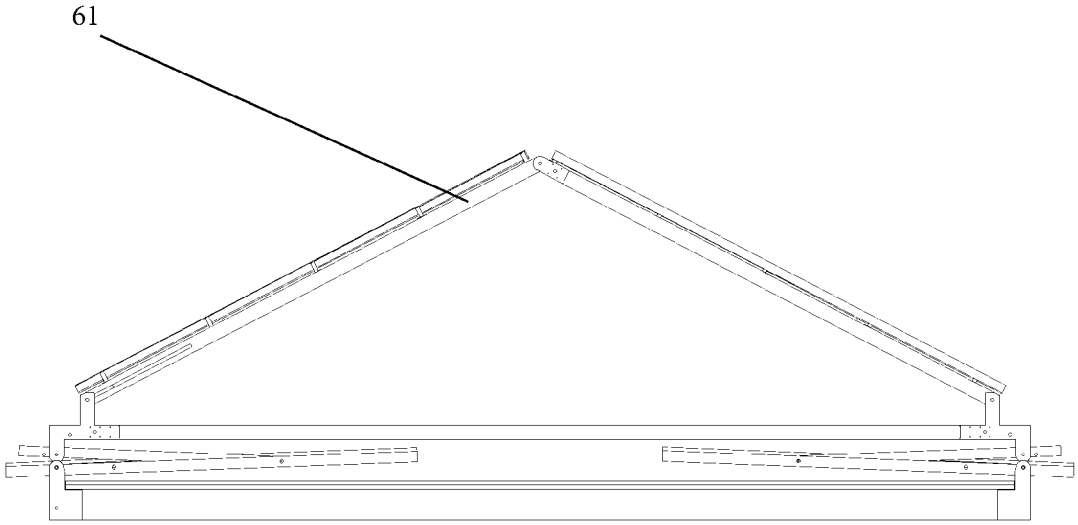

FIG. 46 shows a typical erect roof structure 61

Figure 47:
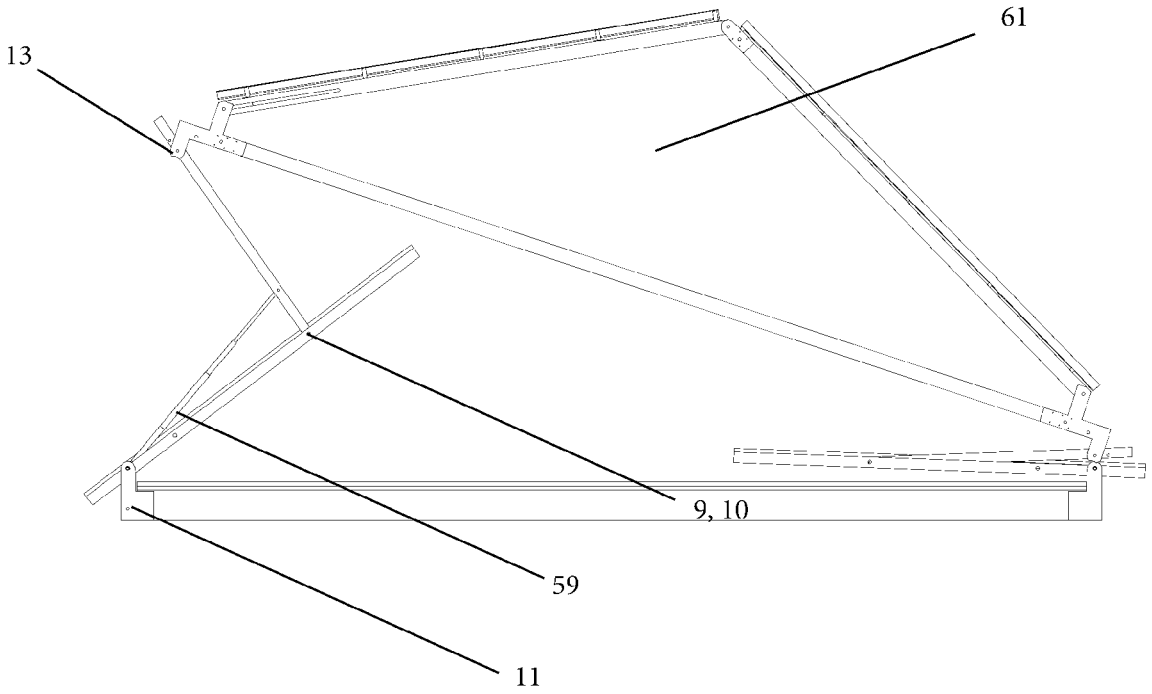

FIG. 47 shows a typical wall structure being erected into its upright position. A mechanical actuator 59, providing the upward force to complete the erection. Detachable floor to wall rotating plate 11, upper and lower midpoint rotating connector plates 9,10 and detachable wall to ceiling rotating connector plates 13 are all articulating to complete the action.

Figure 48:
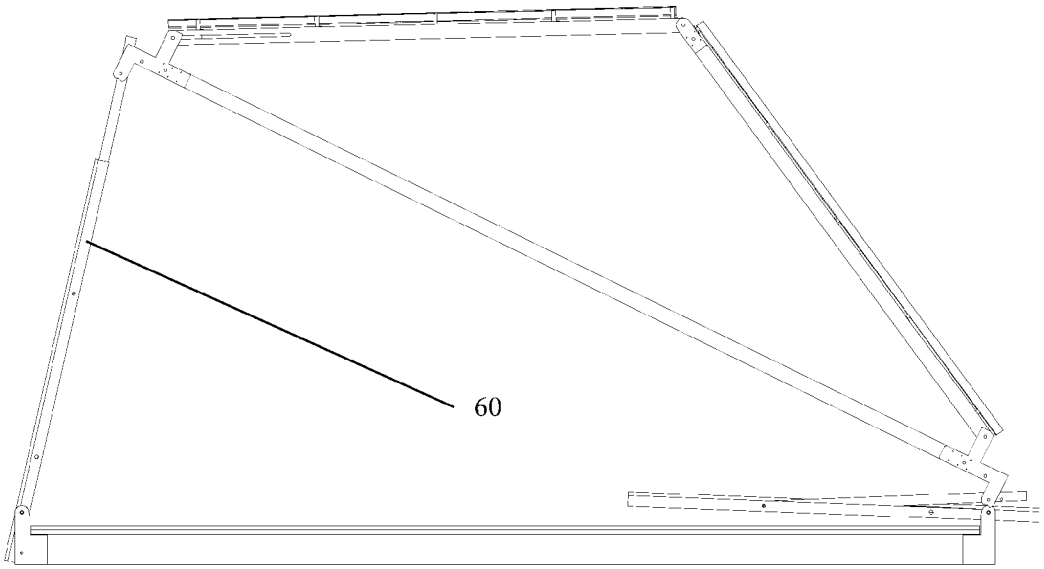

FIG. 48 shows a typical erect wall section 60

Figure 49:
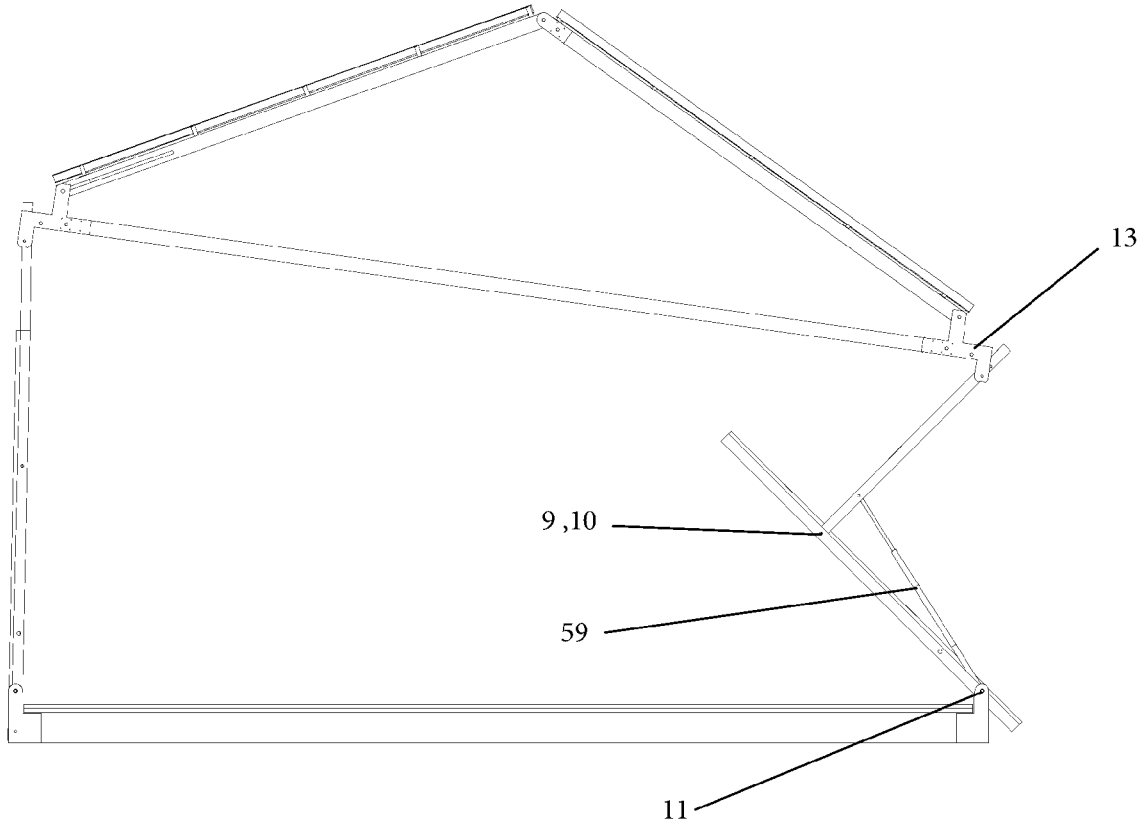

FIG. 49 shows a repeat of the previous typical wall structure being erected into its upright position. A mechanical actuator 59, providing the upward force to complete the erection. Detachable floor to wall rotating plate 11, upper and lower midpoint rotating connector plates 9,10, and detachable wall to ceiling rotating connector plates 13 are all articulating to complete the action.

Figure 50:
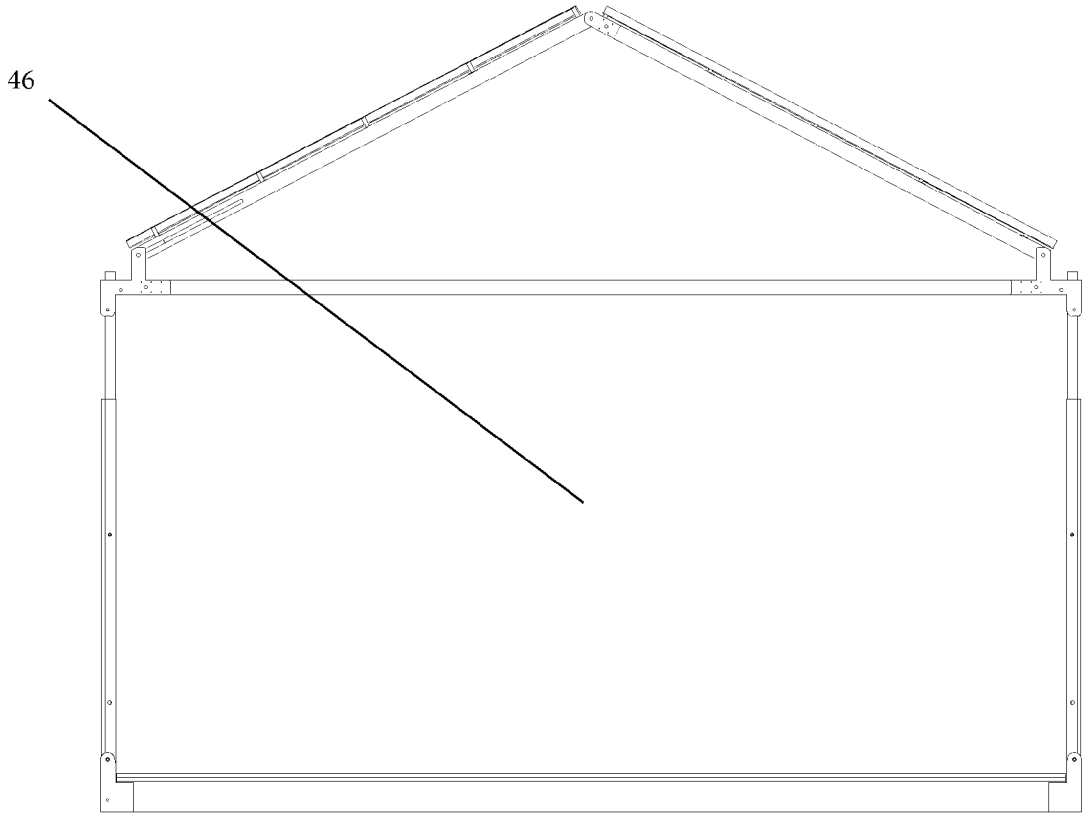

FIG. 50 shows a typical erect building section 46.

Furthermore, the current system may present a few OH&S concerns with loads supported by cranes and people working under a live load.

Accordingly, the present invention provides a modified and refined design utilizing gas struts. Hence, the invention further provides a method of erecting the building with the use of gas struts or electrically powered actuators.

As an optional feature to assemble the modular structure or building, the present invention further provides an actuation mechanism, mechanical actuator 59 attached to each of four corner panels to assist in erection and assembly of the structure from ground level.

While considerable emphasis has been placed herein on the specific features of the preferred embodiment, it will be appreciated that many additional features can be added and that many changes can be made in the preferred embodiment without departing from the principles of the disclosure. These and other changes in the preferred embodiment of the disclosure will be apparent to those skilled in the art from the disclosure herein, whereby it is to be distinctly understood that the foregoing descriptive matter is to be interpreted merely as illustrative of the disclosure and not as a limitation.

The claims defining the invention are as follows:

1. A portable building assembly comprising a plurality of sections, comprising:

floor, wall, ceiling and roof sections;

a Sliding End Wall component;

a Sliding Rotating Roof Panel connection;

a Roof Load Bearing Beam connection point;

a Rotating Concrete Slab Connection Bracket;

rotating connector plates;

a roof load bearing beam;

mechanical fasteners for fastening customised infill panels to the perimeter of the building; and a Customised Infill Panel (CIP), wherein the Sliding End Wall component allows an end wall section to slide backwards out of its flat packed transport position and rotate 90 degrees into its final upright position;

wherein the Sliding Rotating Roof Panel connection allows a roof panel to slide and pivot upward from its flat packed position to create roof structures;

wherein the Roof Load Bearing Beam connection point allows various design layouts to be accommodated by incorporating the Roof Load Bearing Beam into a Wall/Roof connecting rotating connector plate to create openings between individual sections by removing the wall sections to a required length;

wherein wall, ceiling and roof components of the building assembly are connectable to a concrete slab by means of the Rotating Concrete Slab Connection Bracket; and wherein said sections are suitably adapted to be folded in a collapsible state and transported to be erected at a building site as required.

2. The assembly according to claim 1, wherein the Sliding End Wall component allows the end wall section to slide backwards out of its flat packed transport position and rotate 90 degrees into its final upright position, without interfering with a concrete slab structure below.

3. The assembly according to claim 1, wherein the Sliding Rotating Roof Panel connection allows a roof panel to slide and pivot upward from its flat packed position to create roof structures selected from Hip, Gable and Skillion types.

4. The assembly according to claim 1, wherein the wall, ceiling and roof components are connected to an in situ concrete slab by means of the Rotating Concrete Slab Connection Bracket.

5. The assembly according to claim 4, wherein the assembly allows connection of a mechanical fastener through the Bracket into the concrete slab.

6. The assembly according to claim 1, wherein wall support sections may be removed to allow installation of the Customised Infill Panel.

7. The assembly according to claim 1, wherein modular sections are fitted to allow customization of the building.

8. The assembly according to claim 1, wherein the rotating connector plates allow floor, wall, and roof components to be fixed in place during transport, preventing collision between panels.

9. The assembly according to claim 8, wherein upon installation, each plate has a fixed position that locks the floor, wall, and roof components to their final position once erect.

10. The assembly according to claim 8, wherein the rotating connector plates are interlocking or interconnecting.

11. The assembly according to claim 8, wherein the rotating connector plates are both actuating elements for a folding mechanism and structural elements holding the floor, wall, ceiling and roof sections together.

12. The assembly according to claim 1, further comprising an internal lining wall clip to enable all electrical hydraulic and communications services for a house to be pre-installed and connected to services by qualified persons after a main structural installation is complete.

13. The assembly according to claim 8, wherein the rotating connector plates are interconnected allowing the assembly to be lifted in one motion for each section.

14. The assembly according to claim 1, further comprising a single infill panel which is cut to measure and then fitted into a steel frame once erected.

15. The assembly according to claim 1, further comprising a gutter section that is configured to be pre-installed into a roof.

16. The assembly according to claim 1, further comprising an interior/exterior clip on a lining system that allows wall sheets to be pre-fitted and removed as needed to gain wall access.

17. A method of constructing and installing a building assembly according to claim 1, comprising the following steps:

interconnecting a range of articulate components including floor, wall, roof and ceiling connectors; and locking said components into place upon erection by lifting of the assembly in a single motion.

18. The method according to claim 17, wherein the assembly is lifted by means of a Lock and Lift assembly bracket.

19. The method according to claim 18, wherein the assembly is lifted by means of struts attached to corner panels.

20. The assembly according to claim 3, wherein the roof structures are with or without eves.

* * * * *